US010888134B2

(12) United States Patent
Vito

(10) Patent No.: US 10,888,134 B2
(45) Date of Patent: Jan. 12, 2021

(54) HELMET PADDING SYSTEM

(71) Applicant: Robert A. Vito, Kennett Square, PA (US)

(72) Inventor: Robert A. Vito, Kennett Square, PA (US)

(73) Assignee: MATSCITECHNO LICENSING COMPANY, Kenneth Square, PA (US)

( * ) Notice: Subject to any disclaimer, the term of this patent is extended or adjusted under 35 U.S.C. 154(b) by 0 days.

(21) Appl. No.: 15/049,696

(22) Filed: Feb. 22, 2016

(65) Prior Publication Data

US 2016/0165997 A1 Jun. 16, 2016

Related U.S. Application Data

(60) Continuation-in-part of application No. 13/803,539, filed on Mar. 14, 2013, now abandoned, which is a continuation-in-part of application No. 13/740,443, filed on Jan. 14, 2013, now abandoned, application No. 15/049,696, filed on Feb. 22, 2016, which is a continuation-in-part of application No. 13/944,131, filed on Jul. 17, 2013, now abandoned, which is a division of application No. 13/084,866, filed on Apr. 12, 2011, now abandoned, which is a continuation-in-part of application No. 12/570,499, filed on Sep. 30, 2009, now abandoned, which is a continuation-in-part of application No. 11/873,825, filed on Oct. 17, 2007, now Pat. No. 8,413,262, which is a continuation-in-part of application No.

(Continued)

(51) Int. Cl.
*A42B 3/12* (2006.01)

(52) U.S. Cl.
CPC ..... *A42B 3/127* (2013.01)

(58) Field of Classification Search
CPC .. A42B 3/20; A42B 3/00; A42B 3/124; A42B 3/121; A42B 3/324; A42B 3/04; A42B 3/06; A42B 3/127; A42B 3/125; A42B 3/10; A42B 3/16; A42B 3/0473; A42B 3/08; A42B 3/122; A42B 3/064; A42B 3/12; A42B 3/046; A42B 3/128; A42B 1/08; A42B 1/12; A42B 3/063; A42B 3/283
USPC ..... 2/414, 267, 412, 22, 455, 2
See application file for complete search history.

(56) References Cited

U.S. PATENT DOCUMENTS 3,153,792 A * 10/1964 Marietta ..... A42B 3/127 2/414
3,242,500 A * 3/1966 Derr ..... A42B 3/063 2/205

(Continued)

FOREIGN PATENT DOCUMENTS

WO WO 2007067405 A1 * 6/2007 ..... A41D 31/0027

*Primary Examiner* — Alissa L Hoey
*Assistant Examiner* — Catherine M Ferreira
(74) *Attorney, Agent, or Firm* — Thomas J. McWilliams; Barnes & Thornburg LLP

(57) ABSTRACT

Helmet padding systems and apparatuses are disclosed. A helmet padding system includes a rigid frame and a spacing pad. The rigid frame is configured to be positioned on the head of a user. The spacing pad includes a layer of elastomeric material. The spacing pad includes a central portion and a plurality of extending portions projecting outward from the central portion. The plurality of extending portions are fixed to the frame.

24 Claims, 23 Drawing Sheets

Related U.S. Application Data

11/635,939, filed on Dec. 8, 2006, now abandoned, which is a continuation-in-part of application No. 11/304,995, filed on Dec. 15, 2005, now abandoned, which is a continuation-in-part of application No. 11/304,079, filed on Dec. 5, 2005, now abandoned, which is a continuation-in-part of application No. 11/019,568, filed on Dec. 22, 2004, now Pat. No. 7,171,697, which is a continuation-in-part of application No. 10/999,246, filed on Nov. 30, 2004, now abandoned, which is a continuation-in-part of application No. 10/958,611, filed on Oct. 5, 2004, now Pat. No. 7,150,113, which is a continuation-in-part of application No. 10/958,745, filed on Oct. 5, 2004, now Pat. No. 8,142,382, which is a continuation-in-part of application No. 10/958,952, filed on Oct. 5, 2004, now abandoned, which is a continuation-in-part of application No. 10/958,767, filed on Oct. 5, 2004, now abandoned, which is a continuation-in-part of application No. 10/958,941, filed on Oct. 5, 2004, now abandoned, which is a continuation-in-part of application No. 10/856,215, filed on May 28, 2004, now Pat. No. 6,942,586, which is a continuation-in-part of application No. 10/659,560, filed on Sep. 10, 2003, now Pat. No. 6,935,973, which is a division of application No. 09/939,319, filed on Aug. 27, 2001, now Pat. No. 6,652,398.

(60) Provisional application No. 61/706,922, filed on Sep. 28, 2012, provisional application No. 61/699,944, filed on Sep. 12, 2012.

(56) References Cited

U.S. PATENT DOCUMENTS

| | | | | | |
|---|---|---|---|---|---|
| 4,232,069 | A * | 11/1980 | Windecker | B32B 3/16 | 428/325 |
| 4,513,449 | A * | 4/1985 | Donzis | A41D 13/0153 | 2/22 |
| 5,503,879 | A * | 4/1996 | Cochran | C08J 5/04 | 264/257 |
| 6,282,724 | B1 * | 9/2001 | Abraham | A41D 13/015 | 2/267 |
| 6,301,722 | B1 * | 10/2001 | Nickerson | A41D 13/015 | 2/22 |
| 2012/0036620 | A1 * | 2/2012 | Harris | A42B 3/127 | 2/414 |

* cited by examiner

HELMET PADDING SYSTEM

CROSS-REFERENCE TO RELATED APPLICATIONS

This application is a Continuation-in-Part (CIP) of U.S. Ser. No. 13/803,539, filed Mar. 14 2013, entitled "HELMET PADDING SYSTEM," which is a Continuation-in-Part (CIP) of U.S. Ser. No. 13/740,443, filed Jan. 14, 2013, entitled "HELMET PADDING SYSTEM," which claims priority to U.S. 61/706,922, filed Sep. 28, 2012, entitled "PROTECTIVE HEADGEAR SYSTEM," and U.S. 61/699,944, filed Sep. 12, 2012, entitled "HELMET PADDING SYSTEM," all of which are incorporated herein by reference in their entireties; this application is also a Continuation-in-Part (CIP) of U.S. Ser. No. 13/944,131, filed Jul. 17, 2013, entitled "VIBRATION DAMPENING MATERIAL," which is a Divisional application of U.S. Ser. No. 13/084,866, filed Apr. 12, 2011, entitled "VIBRATION DAMPENING MATERIAL", which is a Continuation-in-Part (CIP) of U.S. Ser. No. 12/570,499 (U.S. Pat. No. 8,413,262), filed Sep. 30, 2009, entitled "VIBRATION DAMPENING MATERIAL AND METHOD OF MAKING SAME," which is a Continuation-in part (CIP) of U.S. Ser. No. 11/873,825 (U.S. Pat. No. 8,413,262), filed Oct. 17, 2007, entitled "SOUND DISSIPATING MATERIAL," which is a Continuation-in-Part (CIP) of U.S. Ser. No. 11/635,939, filed Dec. 8, 2006, entitled "VIBRATION DAMPENING MATERIAL AND METHOD OF MAKING SAME," which is a Continuation-in-Part (CIP) of U.S. Ser. No. 11/304,995, filed Dec. 15, 2004, entitled "VIBRATION DAMPENING MATERIAL AND METHOD OF MAKING SAME, which is a Continuation-in-Part (CIP) of U.S. Ser. No. 11/304,079, filed Dec. 15, 2005, entitled "VIBRATION DAMPENING MATERIAL AND METHOD OF MAKING SAME," which is a Continuation-in-Part (CIP) of U.S. Ser. No. 11/019,568 (U.S. Pat. No. 7,171,697), filed Dec. 22, 2004, entitled "VIBRATION DAMPENING MATERIAL AND METHOD OF MAKING SAME," which is a Continuation-in-Part (CIP) of U.S. Ser. No. 10/999,246, filed Nov. 30, 2004, entitled "VIBRATION DAMPENING MATERIAL AND METHOD OF MAKING SAME," which is a Continuation-in-Part (CIP) of U.S. Ser. No. 10/958,611 (U.S. Pat. No. 7,150,113), filed Oct. 5, 2004, entitled "SUBSTITUTED ARYLOXIMES," which is a Continuation-in-Part of U.S. Ser. No. 10/958,745 (U.S. Pat. No. 8,142,382), filed Oct. 5, 2004, entitled "VIBRATION DAMPENING MATERIAL AND METHOD OF MAKING SAME," which is a Continuation-in-Part (CIP) of U.S. Ser. No. 10/958,952, filed Oct. 5, 2004, entitled "VIBRATION DAMPENING MATERIAL AND METHOD OF MAKING SAME," which is a Continuation-in-Part (CIP) of U.S. Ser. No. 10/958,767, filed Oct. 5, 2004, entitled "VIBRATION DAMPENING MATERIAL AND METHOD OF MAKING SAME," which is a Continuation-in-Part (CIP) of U.S. Ser. No. 10/958,941, filed Oct. 5, 2004, entitled "VIBRATION DAMPENING MATERIAL AND METHOD OF MAKING SAME," which is a Continuation-in-Part (CIP) of U.S. Ser. No. 10/856,215 (U.S. Pat. No. 6,942,586), filed May 28, 2004, entitled "VIBRATION DAMPENING MATERIAL," which is a Continuation of U.S. Ser. No. 10/659,560 (U.S. Pat. No. 6,935,973), filed Sep. 10, 2003, entitled "VIBRATION DAMPENING MATERIAL," which is a Divisional of U.S. Ser. No. 09/939,319 (U.S. Pat. No. 6,652,398), filed Aug. 27, 2001, entitled "VIBRATION DAMPENING GRIP COVER FOR THE HANDLE OF AN IMPLEMENT," all of which are incorporated herein by reference in their entireties.

FIELD OF THE INVENTION

The invention relates generally to the field of protective headgear, and more particularly, to impact-resistant padding for protective headgear.

BACKGROUND OF THE INVENTION

Conventionally, participants in "contact" sports (e.g., wrestling, football, rugby) wear protective headgear to cushion the force of impacts that are regularly received during those events. In recent years, the negative health effects of the impacts to the head experienced during such contact sports have been a matter of focus. These negative health effects can be diminished or minimized by effectively cushioning participants from the forces of impacts. Accordingly, improved structures, such as impact-resistant headgear, are desired to lessen the impact forces experienced by those participants.

SUMMARY OF THE INVENTION

Aspects of the present invention are directed to helmet padding systems, protective headgear systems, and related apparatuses.

In accordance with one aspect of the present invention, a helmet padding system is disclosed. The system includes a helmet shell, a spacing pad, and a plurality of absorption pads. The helmet shell is configured to be positioned on the head of a user. The spacing pad is coupled to an interior of the helmet shell. The spacing pad includes a layer of elastomeric material. The spacing pad comprises a central portion coupled to a central region of the interior of the helmet shell and a plurality of extending portions projecting outward from the central portion. The plurality of absorption pads are coupled to the spacing pad. The plurality of absorption pads comprise a first absorption pad coupled to the central portion of the spacing pad and remaining absorption pads coupled to ends of the extending portions of the spacing pad.

In accordance with another aspect of the present invention, a padding apparatus for use with a helmet is disclosed. The apparatus includes a spacing pad and a plurality of absorption pads. The spacing pad is configured to be coupled to an interior of the helmet. The spacing pad includes a layer of elastomeric material. The spacing pad comprises a central portion and a plurality of extending portions projecting outward from the central portion. The plurality of absorption pads are coupled to the spacing pad. The plurality of absorption pads comprise a first absorption pad coupled to the central portion of the spacing pad and remaining absorption pads coupled to ends of the extending portions of the spacing pad.

In accordance with yet another aspect of the present invention, a protective headgear system is disclosed. The protective headgear system includes an impact-resistant pad and a helmet. The impact-resistant pad comprises a top portion configured to be positioned covering a top of a user's head, and first and second side portions extending downward from the top portion. The helmet is unconnected to the impact-resistant pad. The helmet is configured to be positioned overtop of the impact-resistant pad when the impact-resistant pad is positioned on the user's head.

In accordance with still another aspect of the present invention, an impact-resistant pad for a protective headgear system is disclosed. The impact-resistant pad includes a top portion configured to be positioned covering a top of a user's head, and first and second side portions extending downward from the top portion. The impact-resistant pad is unconnected to any supporting structure, and is configured to be worn under a helmet.

In accordance with yet another aspect of the present invention, a helmet padding system is disclosed. The system includes a helmet shell, a spacing pad, and a deflection layer. The helmet shell is configured to be positioned on the head of a user. The spacing pad includes a layer of elastomeric material. The spacing pad comprises a central portion and a plurality of extending portions projecting outward from the central portion. The deflection layer is positioned between the helmet shell and the spacing pad. The deflection layer is less flexible than the spacing pad. The system may also include a plurality of absorption pads and/or a deformation layer.

In accordance with still another aspect of the present invention, a helmet padding system is disclosed. The helmet padding system comprises a rigid frame and a spacing pad. The rigid frame is configured to be positioned on the head of a user. The spacing pad includes a layer of elastomeric material. The spacing pad comprises a central portion and a plurality of extending portions projecting outward from the central portion. The plurality of extending portions are fixed to the frame.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

The embodiments of the invention described herein relate to helmet padding and protective headgear systems that incorporate impact-resistant pads beneath a user's helmet to cushion impacts on the helmet from the user's head. As used herein, the term "helmet" is not intended to be limited, but is meant to encompass any headgear worn for protection during an activity in which an impact to the head may occur. Additionally, as used herein, the term "impact-resistant" is intended to encompass any object that partially or fully lessens, diminishes, dissipates, deflects, or absorbs the mechanical force of an impact.

The exemplary systems and apparatus disclosed herein are configured to lessen the force of an impact on the user's head. This makes them particularly suitable for use by participants in athletic activities, and particularly suitable for participants in traditional "contact" sports, such as wrestling, American football, or rugby, where high-force impacts may be commonly experienced. While the exemplary embodiments of the invention are described herein with respect to athletic activities, it will be understood that the invention is not so limited. Suitable applications for the systems and apparatus of the present invention include, for example, military helmets or construction helmets. Other suitable applications will be readily understood by one of ordinary skill in the art from the description herein.

Figure 1:
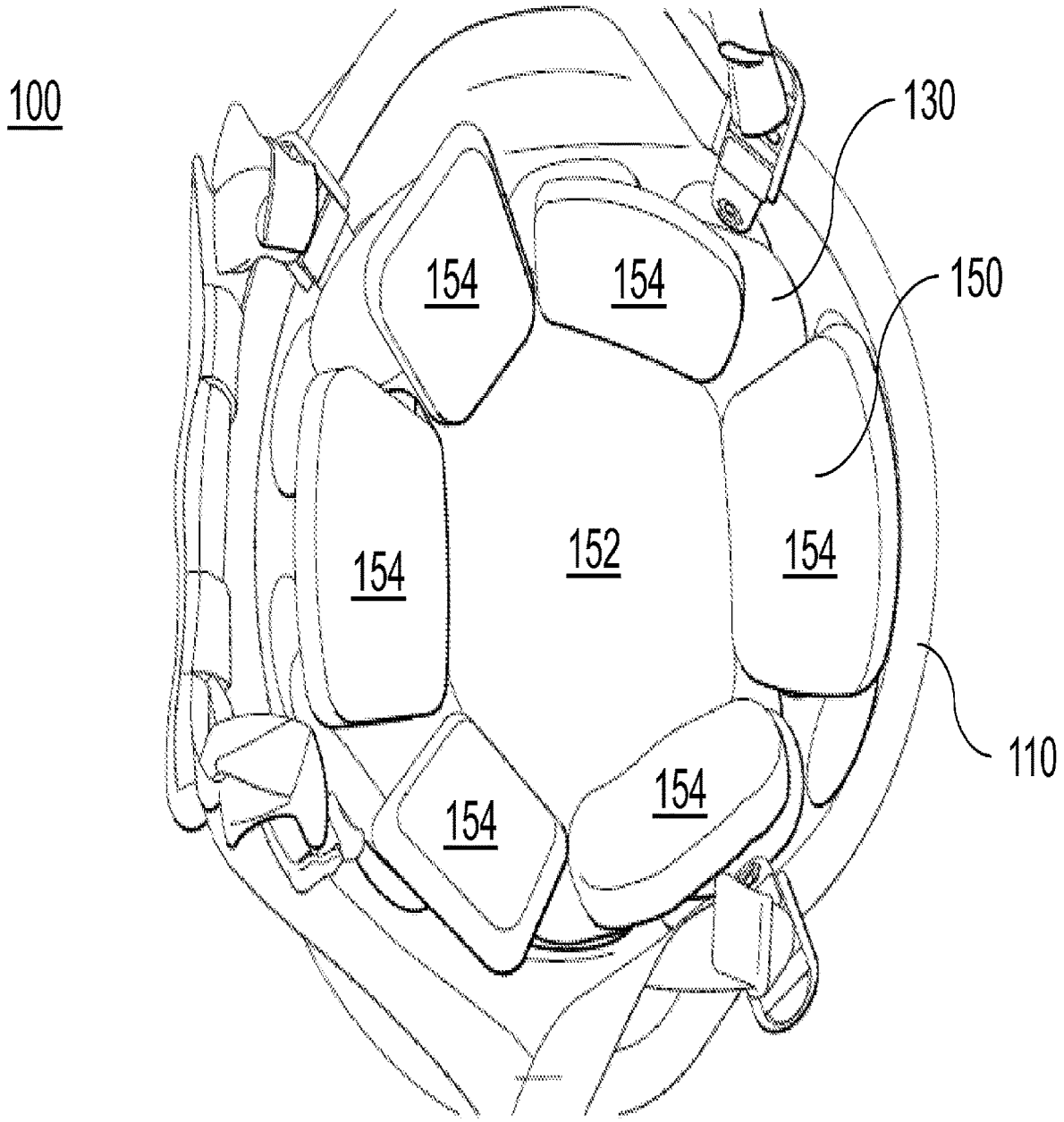
FIG. 1 is an image illustrating an exemplary helmet padding system in accordance with aspects of the present invention.

Referring now to the drawings, FIG. 1 illustrates an exemplary helmet padding system 100 in accordance with aspects of the present invention. Helmet padding system 100 may be worn by a user during an athletic activity. As a general overview, system 100 includes a helmet shell 110, a spacing pad 130, and a plurality of absorption pads 150. Additional details of system 100 are described herein.

Figure 2:
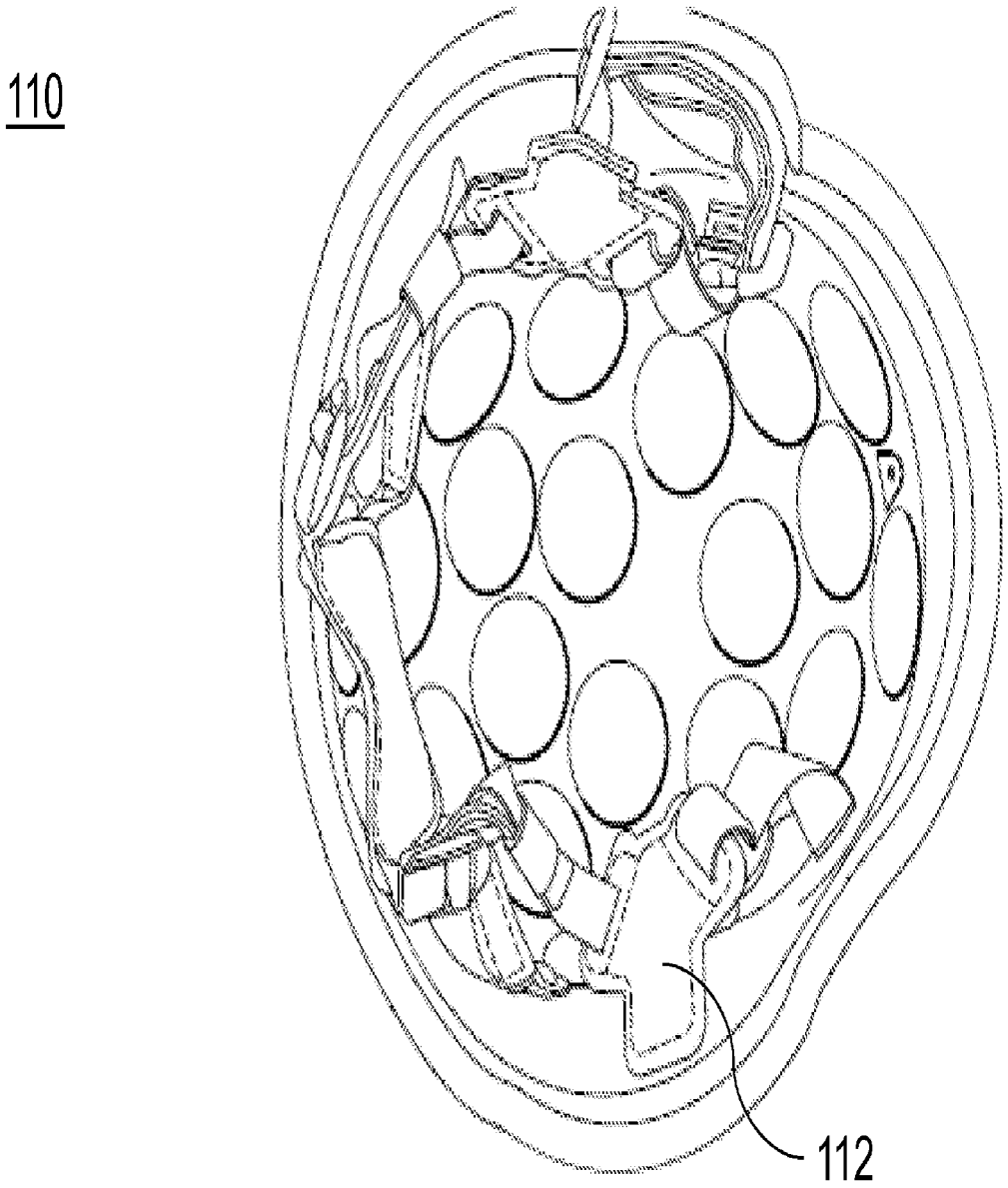
FIG. 2 is an image illustrating an exemplary helmet shell of the helmet padding system of FIG. 1.

Helmet shell 110 is configured to be positioned on a user's head. As shown in FIGS. 1 and 2, helmet shell 110 completely encloses the upper portion of the user's head. This may be desirable in order to ensure any impacts to the user's head are absorbed by helmet padding system 100. Helmet shell 110 may include one or more straps 112 for securing helmet shell 110 to the user's head. The size of helmet shell 110 is selected such that helmet shell 110 can accommodate the remaining components of system 100 while still being securely positioned on the user's head. Where helmet shell 110 is a conventional helmet shell, it will be understood that helmet shell 110 may include its own integral, connected foam pads in addition to the pads described with respect to system 100. It will be understood that the pads described with respect to system 100 may be pads provided in addition to the pads provided in conventional helmet shells 110.

Suitable helmet shells 110 for use with the present invention will be known to one of ordinary skill in the art from the description herein.

Spacing pad 130 is positioned within the interior of helmet shell 110. As shown in FIGS. 4-8, spacing pad 130 comprises a central portion 132 and a plurality of extending portions 134 projecting outward from the central portion. Spacing pad 130 may or may not be coupled to the interior of helmet shell 110. When spacing pad 130 is coupled to helmet shell 110, central portion 132 is coupled to a central region of the interior of helmet shell 110, such that extending portions 134 project toward the peripheral edges of helmet shell 110.

Spacing pad 130 is formed from impact-resistant materials. For example, spacing pad 130 may include a layer of elastomeric material. The elastomeric material may provide impact-resistance by absorbing and dissipating the force of impacts laterally along the surface of the elastomeric material. In one exemplary embodiment, spacing pad 130 consists of only a single layer of elastomeric material. In another exemplary embodiment, spacing pad 130 comprises two or more layers of elastomeric material. Spacing pad 130 may include the layers of elastomeric material directly adjacent each other, or in a more preferred embodiment, may include a layer of high tensile strength fibrous material between the layers of elastomeric material.

Suitable materials for forming the elastomeric layer(s) include, but are not limited to, urethane rubbers, silicone rubbers, nitrile rubbers, butyl rubbers, acrylic rubbers, natural rubbers, styrene-butadiene rubbers, and the like. In general, any suitable elastomer material can be used to form the above-described elastomeric layers without departing from the scope of the present invention. Suitable materials for forming the layer of high tensile strength fibrous material include, but are not limited to, aramid fibers, fiberglass, or other high tensile strength fibers. The fibers may be woven to form a cloth layer that is disposed between and generally separates the opposing elastomeric layers. The high tensile strength fibrous material layer may desirably block and redirect impact energy that passes through one of the elastomeric layers. Additional description of materials for forming spacing pad 130 may be found in co-pending U.S. patent application Ser. No. 13/331,004, the contents of which are incorporated herein by reference in their entirety.

Figure 4:
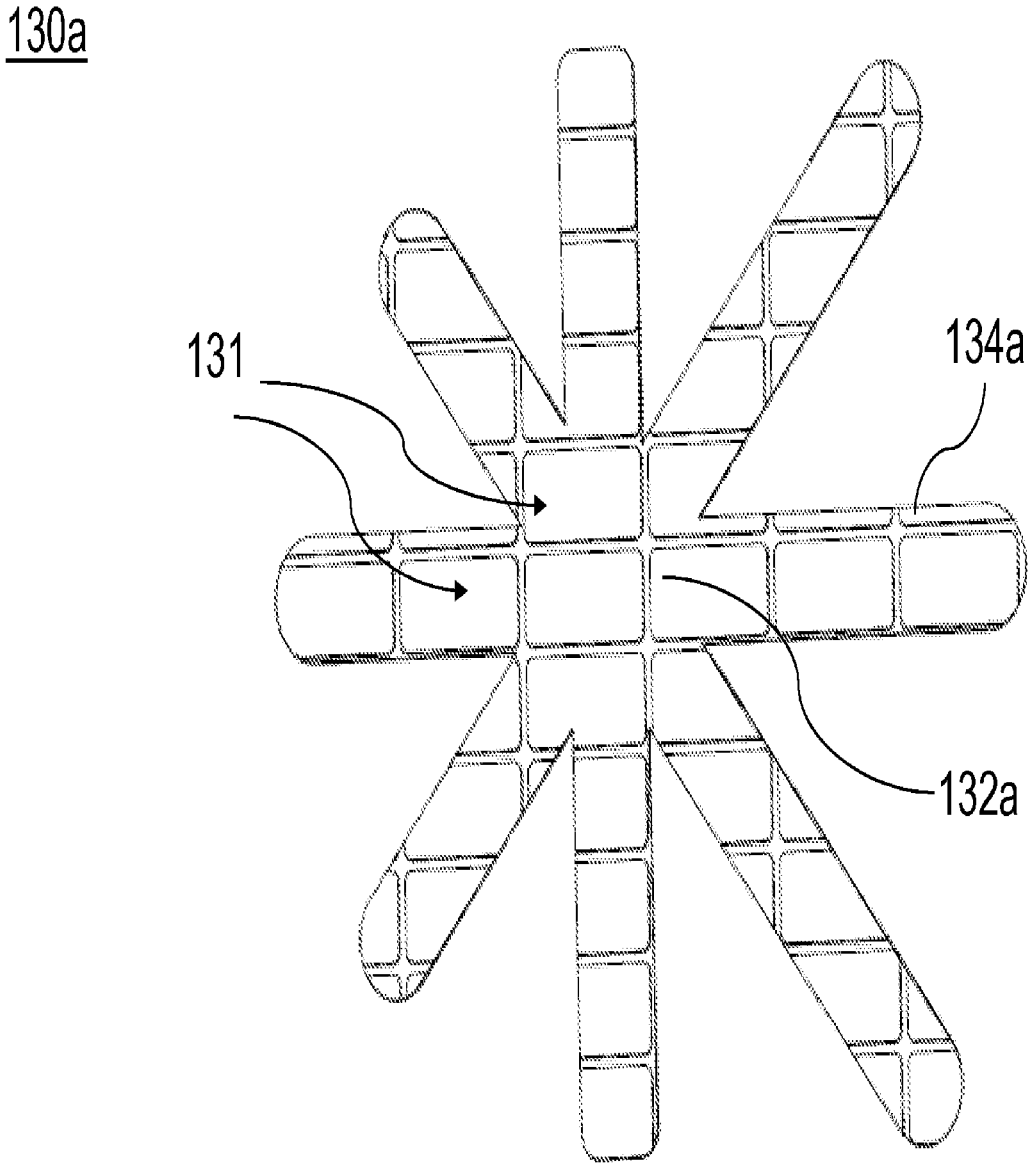
FIG. 4 is an image illustrating an exemplary spacing pad of the helmet padding system of FIG. 1.

As shown in FIG. 4, spacing pad 130 may comprise an array of raised portions 131 formed on a surface thereof. Raised portions 131 may have a rectangular shape, as shown in FIG. 4. However, one of ordinary skill in the art will understand that other shapes may be chosen. For example, raised portions 131 may have a square shape or a diamond shape. Raised portions 130 desirably enable air circulation across spacing pad 130 and concentrate the load from an impact on spacing pad 130. An array of raised portions 131 having a diamond shape may be particular desirable, as these raised portions 131 may enable greater flexibility of spacing pad 130.

As set forth above, spacing pad 130 may or may not be coupled to the interior helmet shell 110. When spacing pad 130 is coupled to the interior of helmet shell 110, such coupling may be effected, for example, using adhesive. It may be desirable that the surface of spacing pad 130, including the entire lengths of extending portions 134, be adhered to the interior of helmet shell 110. The lengths of extending portions 134 may be limited, to prevent separation of extending portions 134 from helmet shell 110 during an impact that deforms helmet shell 110.

Figure 3:
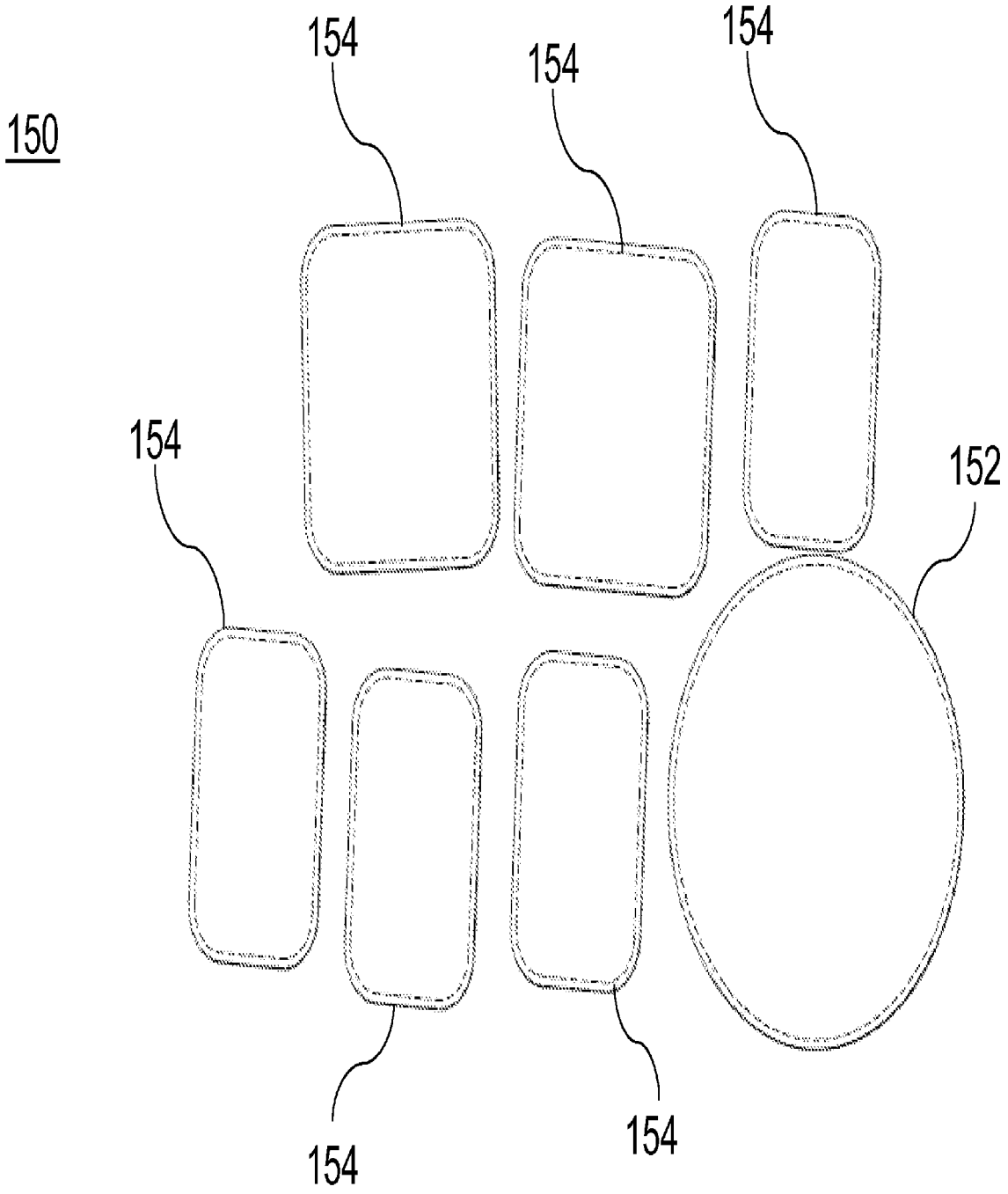
FIG. 3 is an image illustrating exemplary absorption pads of the helmet padding system of FIG. 1.

Absorption pads 150 may be coupled to spacing pad 130. As shown in FIG. 3, the plurality of absorption pads 150 includes a first large absorption pad 152 and a number of remaining absorption pads 154. As shown in FIG. 1, absorption pad 152 is configured to be coupled to the central portion of spacing pad 130, and absorption pads 154 are configured to be coupled to the ends of the extending portions of spacing pad 130.

Absorption pads 150 are desirably shaped such that they do not directly contact helmet shell 110 when spacing pad 130 is coupled to helmet shell 110. Absorption pads 150 may be insulated from helmet shell 110 by the ends of spacing pad 130, and/or may be formed with a preferential curve, in order to create a gap between the outer surfaces of pads 150 and the interior of helmet shell 110. Suitable materials for use in forming absorption pads 150 include, for example, conventional closed or open-cell foams, elastomeric and/or polymer materials. Other materials will be known to one of ordinary skill in the art from the description herein.

FIGS. 4-8 and 13 show different embodiments of spacing pads 130*a*, 130*b*, 130*c*, 130*d* for use with the present invention. Each spacing pad 130*a*, 130*b*, 130*c*, 130*d* includes a respective central portion 132*a*, 132*b*, 132*c*, 132*d* and a respective plurality of extending portions 134*a*, 134*b*, 134*c*, 134*d*. Features of these extending portions 134 will be described herein. It will be understood by one of ordinary skill in the art that any of the features described herein with respect to one embodiment of spacing pad 130 may be provided in any of the other embodiments.

Figure 5:
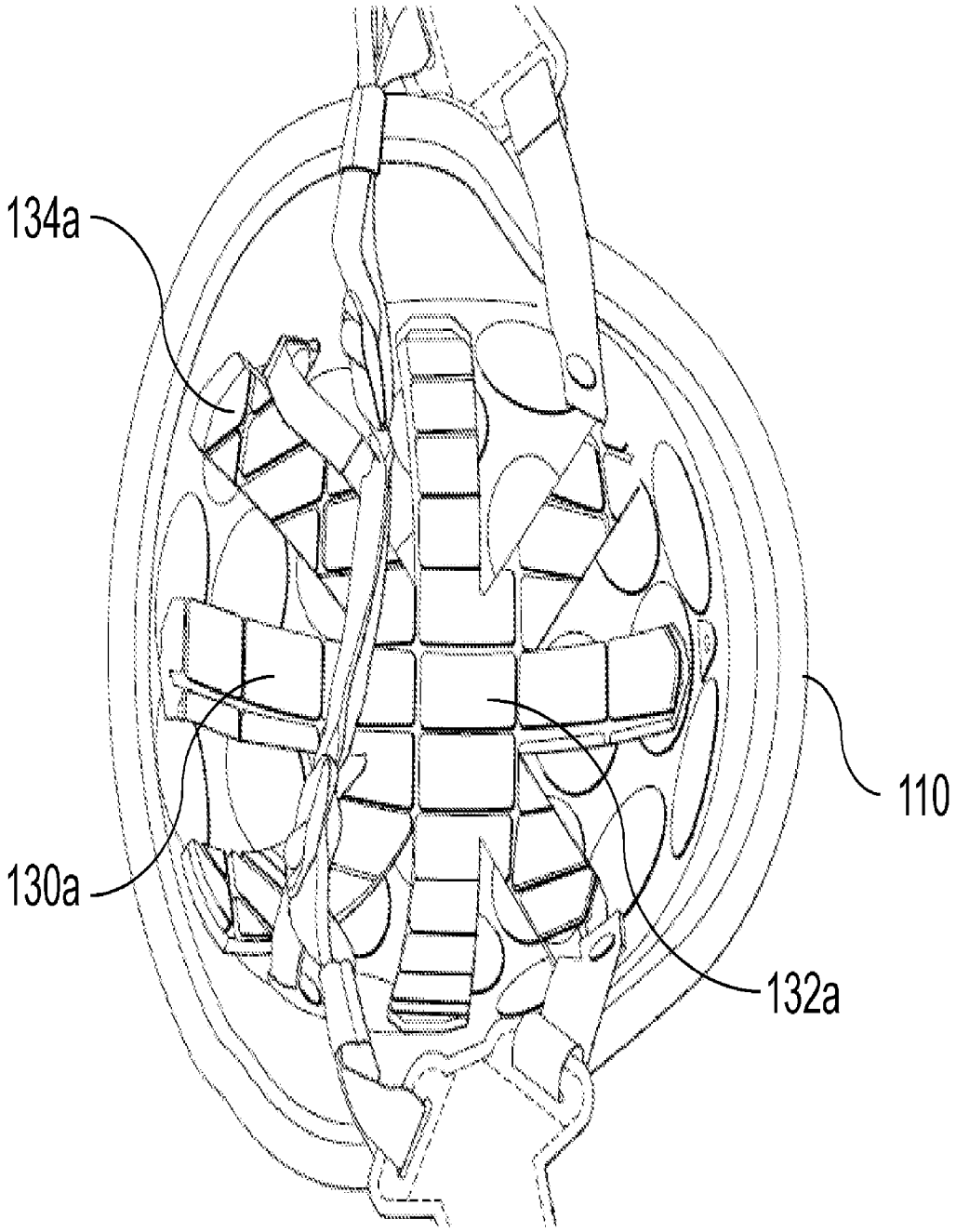
FIG. 5 is an image of the exemplary spacing pad of FIG. 4 in a helmet shell.
Figure 6:
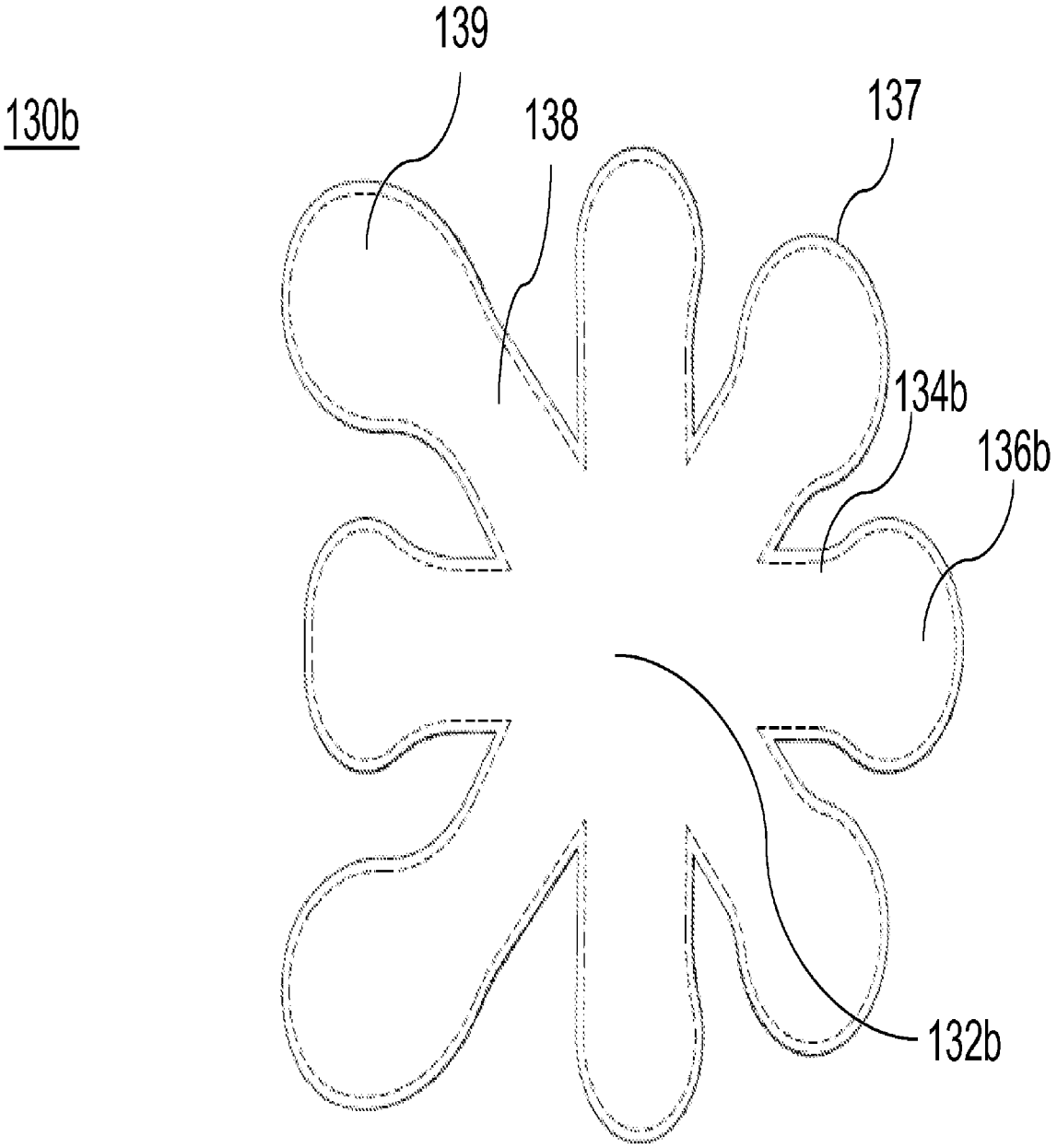
FIG. 6 is an image illustrating another exemplary spacing pad of the helmet padding system of FIG. 1.
Figure 7:
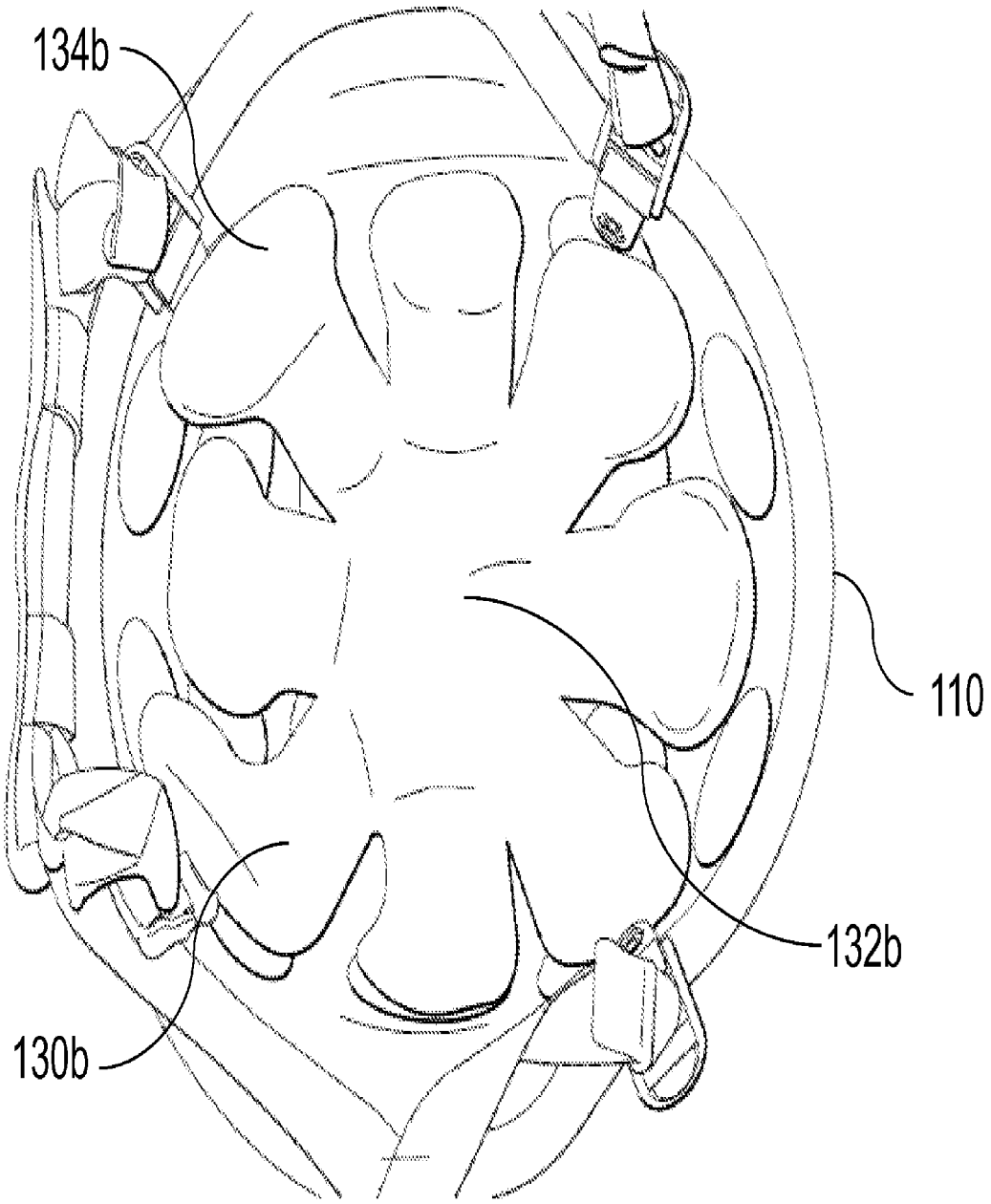
FIG. 7 is an image of the exemplary spacing pad of FIG. 6 in a helmet shell.
Figure 8:
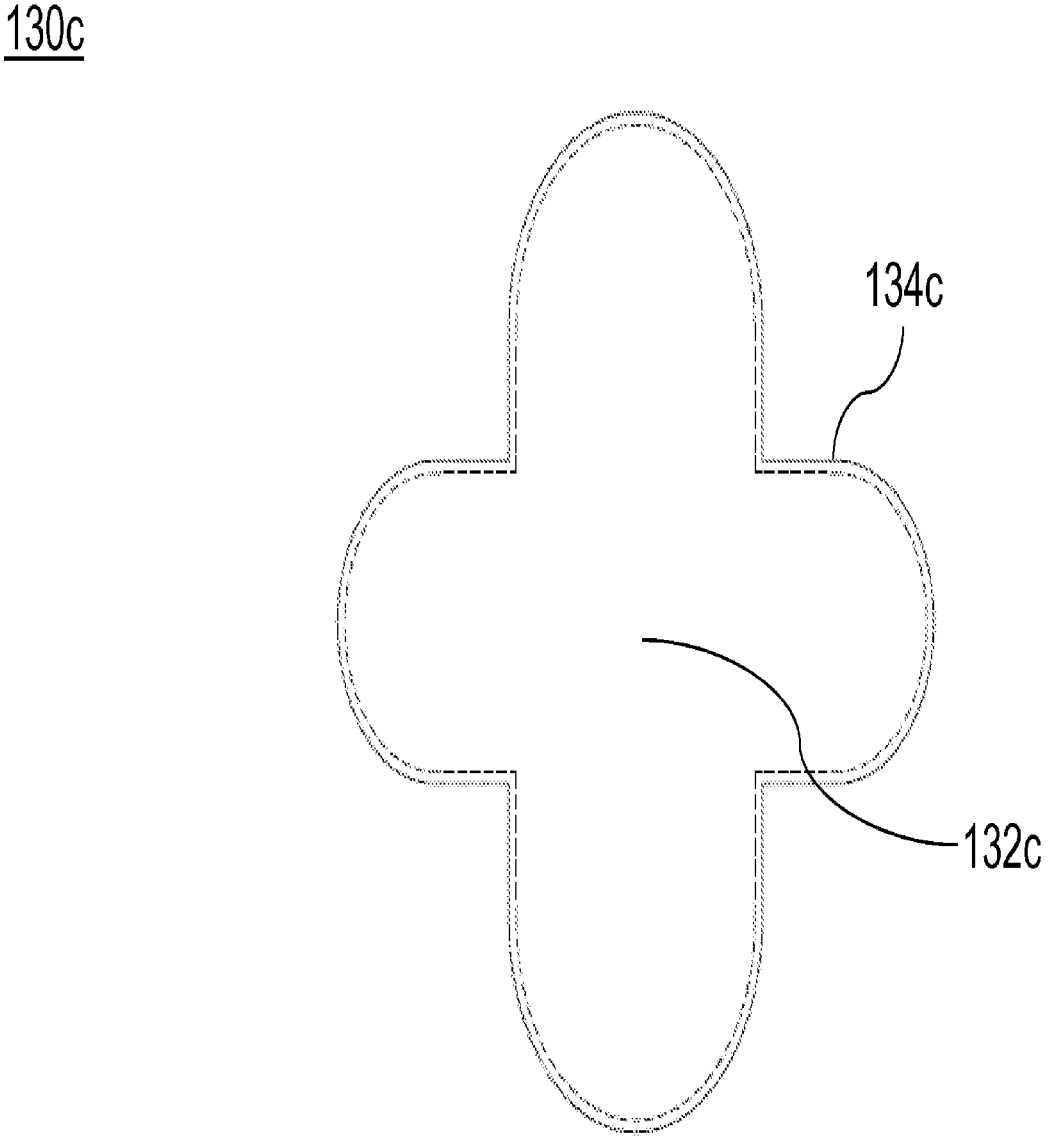
FIG. 8 is an image illustrating yet another exemplary spacing pad of the helmet padding system of FIG. 1.

As shown in FIGS. 4-8, extending portions 134 project outward at regular intervals from their respective central portions 132. As shown in FIGS. 4 and 6, the regular intervals may be approximately every 45.degree. As shown in FIG. 8, the regular intervals may be approximately every 90.degree.

As shown in FIGS. 6 and 7, extending portions 134*b* of spacing pad 130*b* have end portions 136*b*. End portions 136*b* have a width greater than the width of the remainder of the respective extending portion 134*b*. The wider end portions 136*b* of spacing pad 130*b* may be desirable in order to provide a large base for absorption pads 150. The wide end portions 136*b* may be made sufficiently wide that the end portions 136*b* of adjacent extending portions 134*b* overlap with each other when spacing pad 130*b* is positioned within the helmet shell.

Additionally, as shown in FIGS. 6 and 7, spacing pad 130*b* may be contained in a liner 137. Liner 137 may be configured to surround spacing pad 130*b* in order to provide a comfortable contact between the user and spacing pad 130*b*.

As shown in FIG. 8, extending portions 134*c* may be arranged axially symmetrically relative to central portion 132*c*. Alternatively, as shown in FIG. 4, extending portions 134*a* may be arranged axially asymmetrically. Additionally, as shown in FIG. 4, extending portions 134*a* may have varying lengths projecting from central portion 132*a*.

The shapes and sizes of extending portions 134*a*, 134*b*, 134*c* may also be dependent on the configuration of helmet shell 110, as set forth below.

As shown in FIGS. 5 and 7, the varying lengths of extending portions 134 may be selected to correspond to a peripheral contour of helmet shell 110. In other words, if the periphery of the helmet shell 110 has a varying contour, the lengths of extending portions 134 may be selected such that, when spacing pad 130 is coupled to helmet shell 110, the end of each extending portion 134 projects to within a specified distance of the periphery of helmet shell 110. In an exemplary embodiment, extending portions 134 project to within 0.125-2.0 inches of the periphery of helmet shell 110.

Helmet shell 110 may include features that would interfere with the path of extending portions 134. Accordingly, as shown in FIGS. 6 and 7, extending portions 134*b* may be shaped to avoid interfering features in helmet shell 110, i.e., by changing direction. As shown in FIG. 6, at least one of the extending portions 134*b* may have a first portion 138 extending in a first direction and a second portion 139 extending from the first portion 138 in a second direction different from the first direction. This may desirably ensure that the entire length of extending portion 134*b* is adhered to the interior of helmet shell 110.

Figure 13:
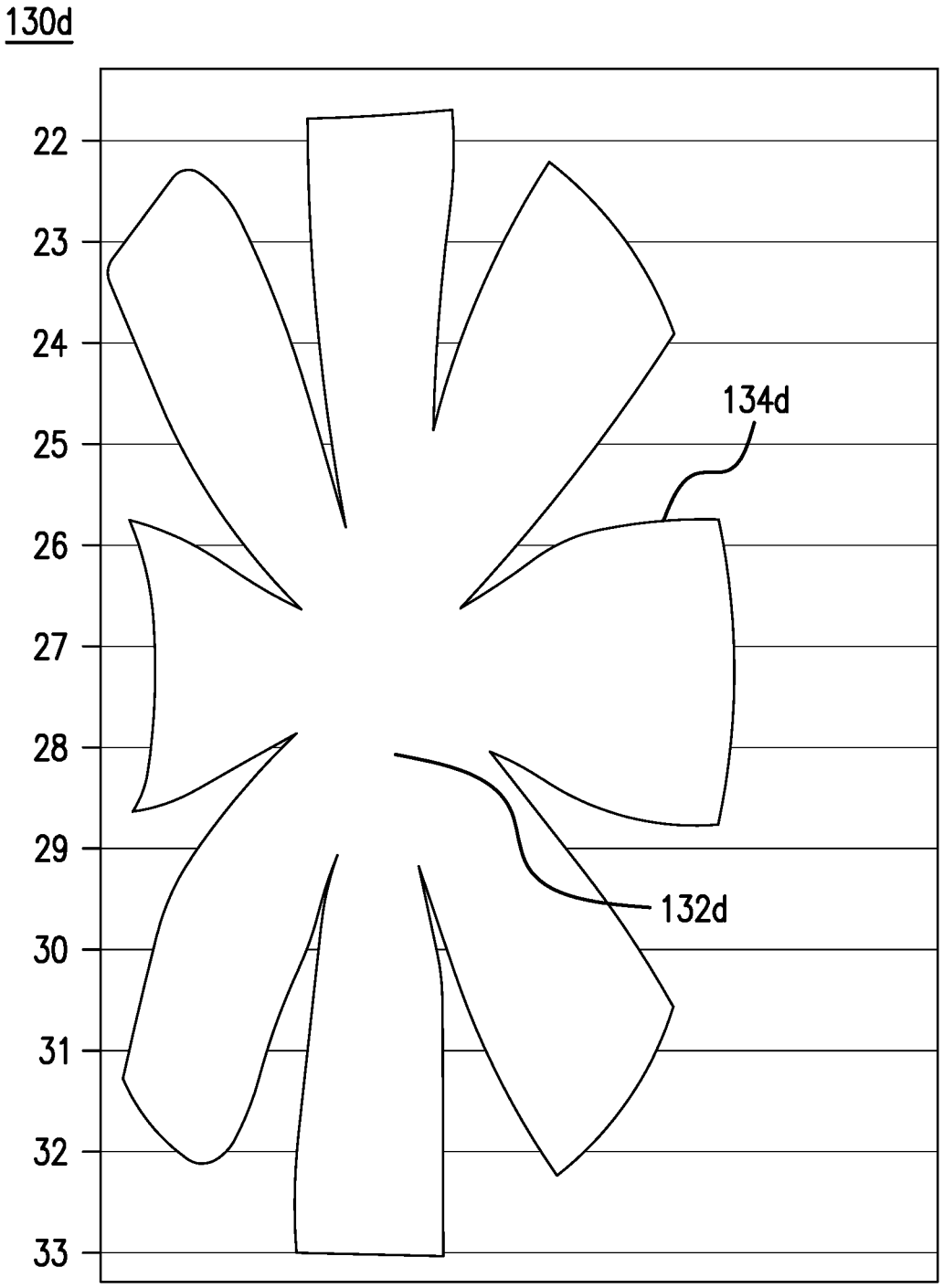
FIG. 13 is an image illustrating another exemplary spacing pad of the helmet padding system of FIG. 1.

Additionally, as shown in FIG. 13, a spacing pad 130*d* may be intended for use in a baseball cap having a rear cut-out (e.g., for access to an adjustable strap). In this embodiment, one of extending portions 134*d* may be shortened and have a rounded edge relative to the other extending portions. This extending portion may be positioned to extend toward the rear cut-out of the baseball cap. This feature may desirably enable all of spacing pad 130*d* to fit comfortably within the baseball cap.

The width and number of extending portions 134 may be selected based on the circumference and size of helmet shell 110. As shown in FIGS. 4 and 6, spacing pad 130 may include a relatively large number of thin extending portions 134. Alternatively, as shown in FIG. 8, spacing pad 130 may include a relatively small number of thick extending portions 134. In an exemplary embodiment, extending portions 134 have a width of approximately 1" to approximately 4".

It will be understood that the number, shape, and size of extending portions 134 in FIGS. 4-8 is shown merely for the purposes of illustration, and is not intended to be limiting. Spacing pads 130 having different numbers of extending portions 134 or differently shaped and sized extending portions 134 may be used without departing from the scope of the present invention, as would be understood by one of ordinary skill in the art from the description herein.

FIGS. 9A-9D illustrate an exemplary impact-resistant pad 200 in accordance with aspects of the present invention. Impact-resistant pad 200 may be worn by a user as part of a protective headgear system during an athletic activity, such as a wrestling match. As a general overview, impact-resistant pad 200 includes a top portion 220 and side portions 240 and 250. Additional details of impact-resistant pad 200 are described herein.

Top portion 220 is configured to be positioned covering a top of the user's head. As shown in FIGS. 9A-9D top portion 220 may be approximately circular, and is sized to cover substantially the entire top of the user's head. In an exemplary embodiment, top portion 220 includes a plurality of openings 222. Openings 222 desirably provide ventilation to the user's head during use of impact-resistant pad 200. As shown in FIG. 9D, openings 222 are formed around the periphery of top portion 220.

Side portions 240 and 250 extend downward from top portion 220. As used herein, the term "side portion" is not intended to mean that portions 240 and 250 are on the "side" of the user's head (as opposed to the front or back). To the contrary, portions 240 and 250 may be located on any side of the user's head. As shown in FIGS. 9B and 9C side portions 240 and 250 cover a front portion and a back portion of the user's head, respectively. As further illustrated in FIG. 9A, back portion 250 extends a greater distance from top portion 220 than front portion 240. This may be desirable in order to provide greater protection to the back of the user's head, and to prevent obstructing the user's view.

Figure 9A:
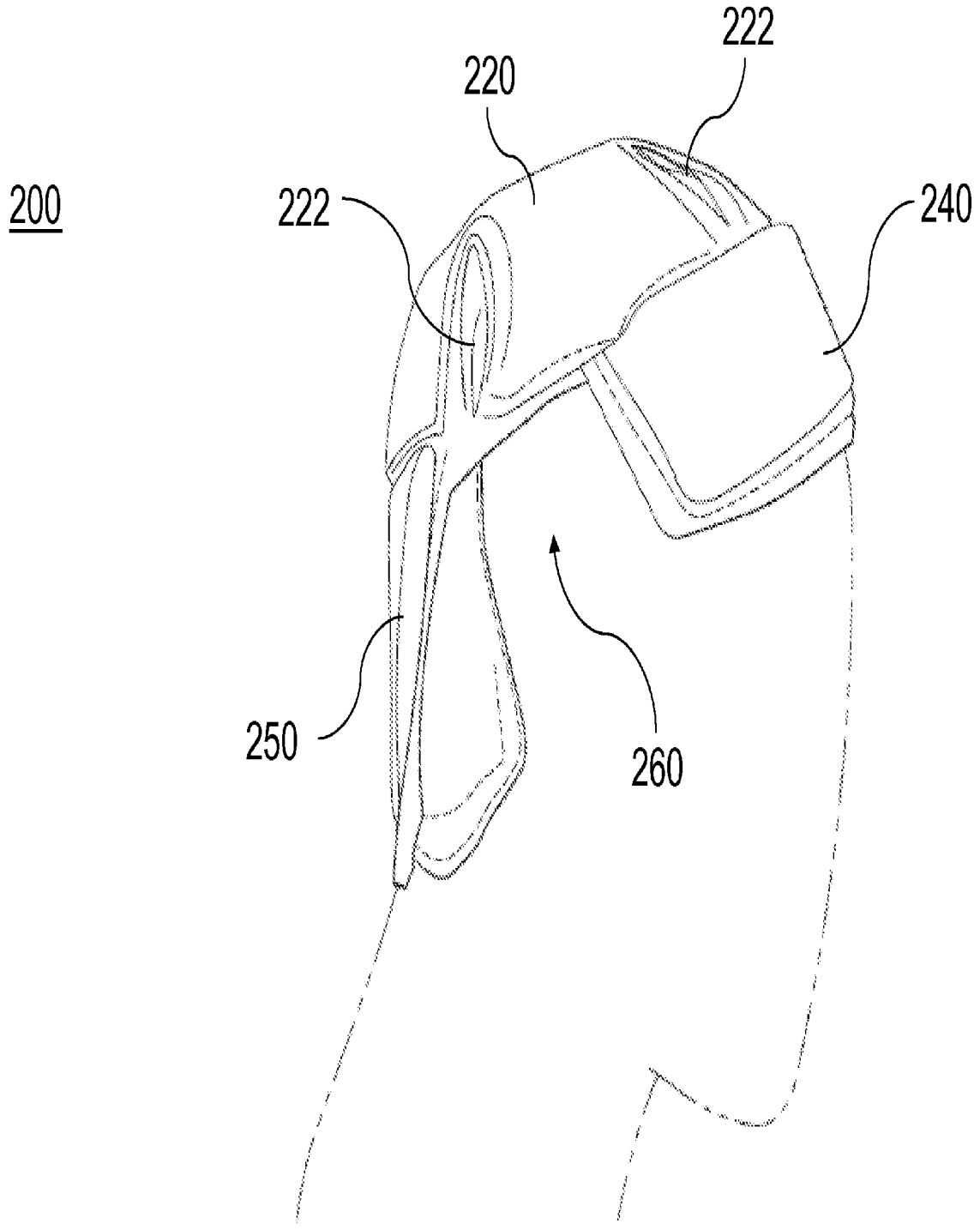
FIGS. 9A-9D are images illustrating an exemplary impact-resistant pad in accordance with aspects of the present invention.
Figure 9B:
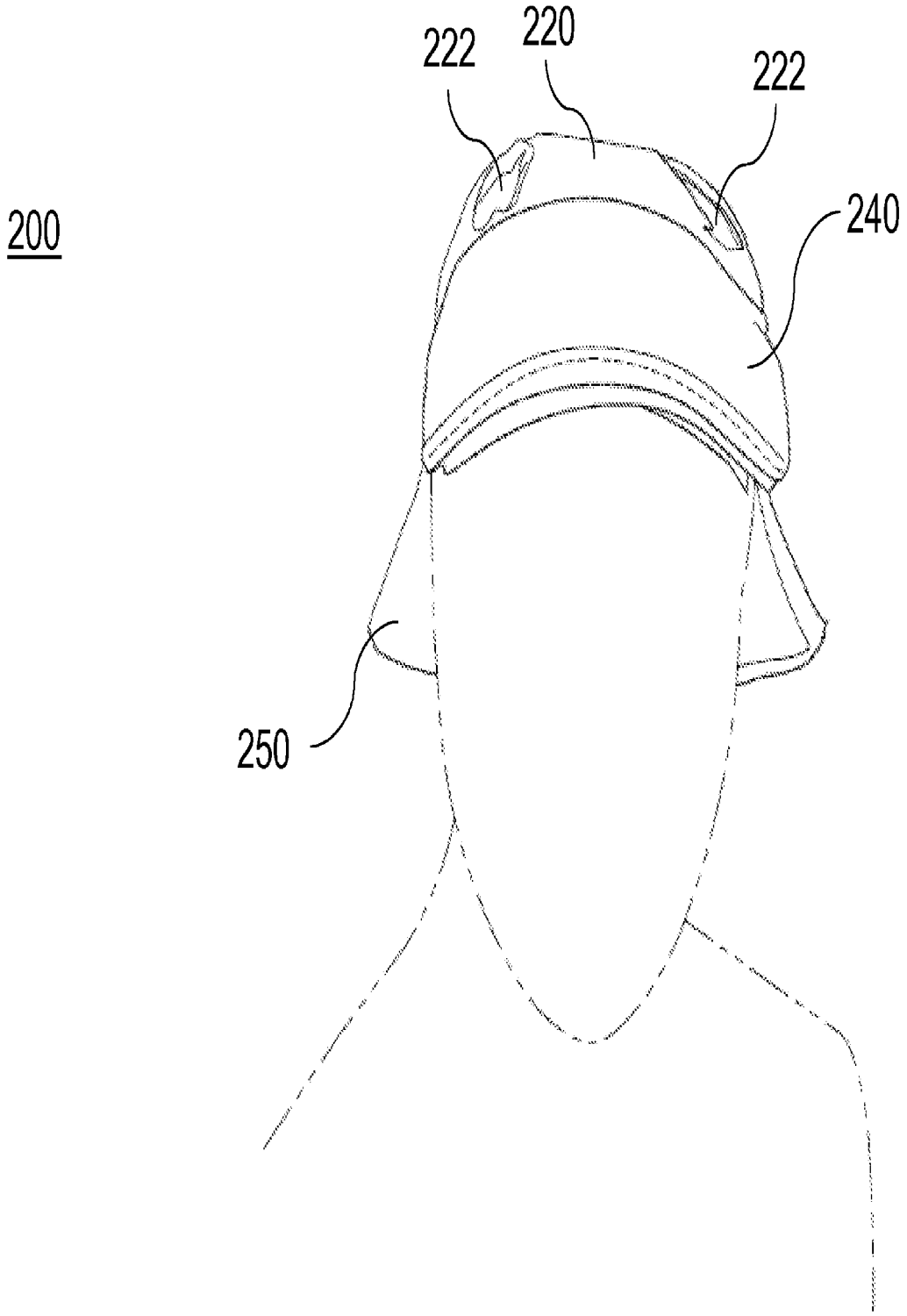
Figure 9C:
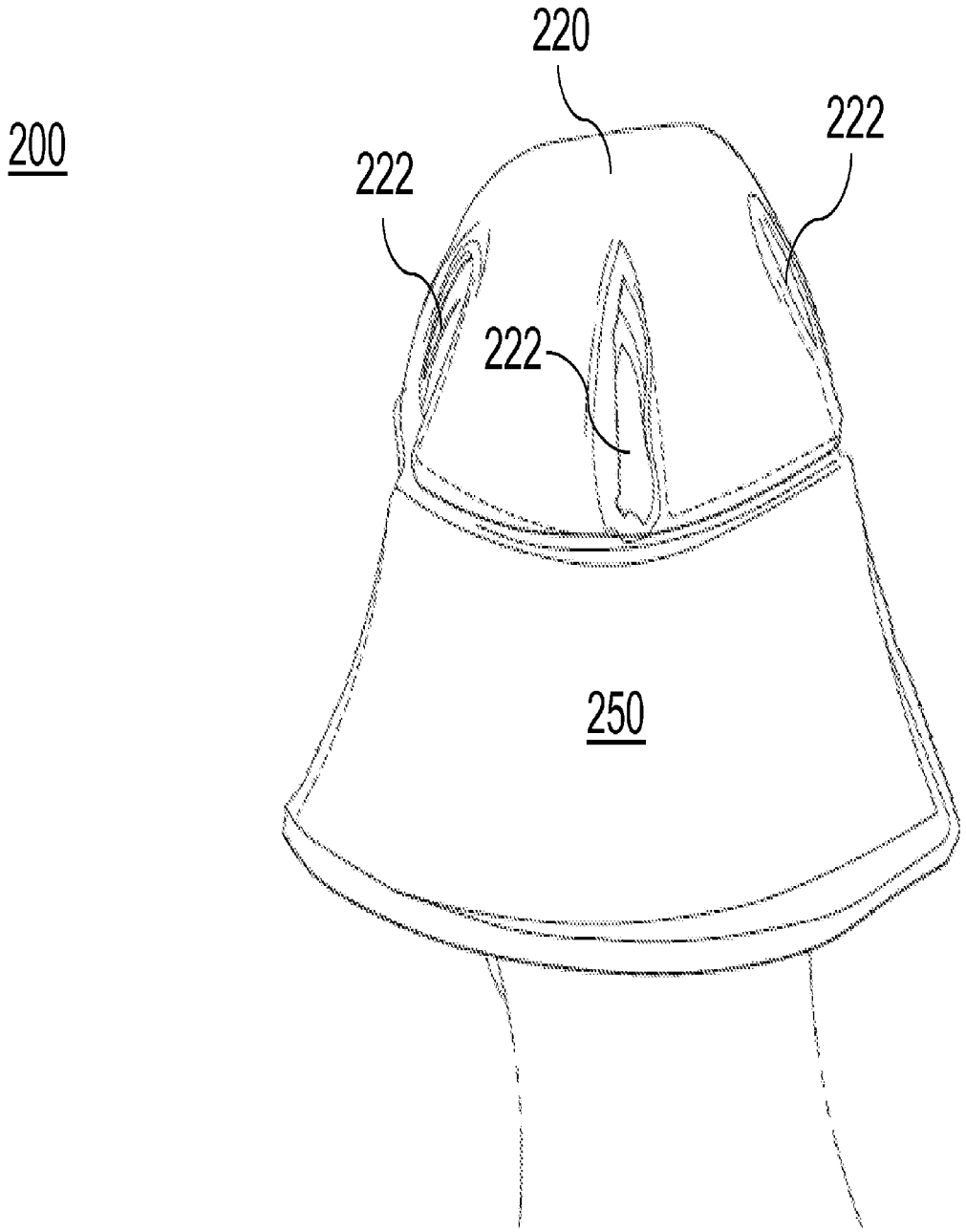
Figure 9D:
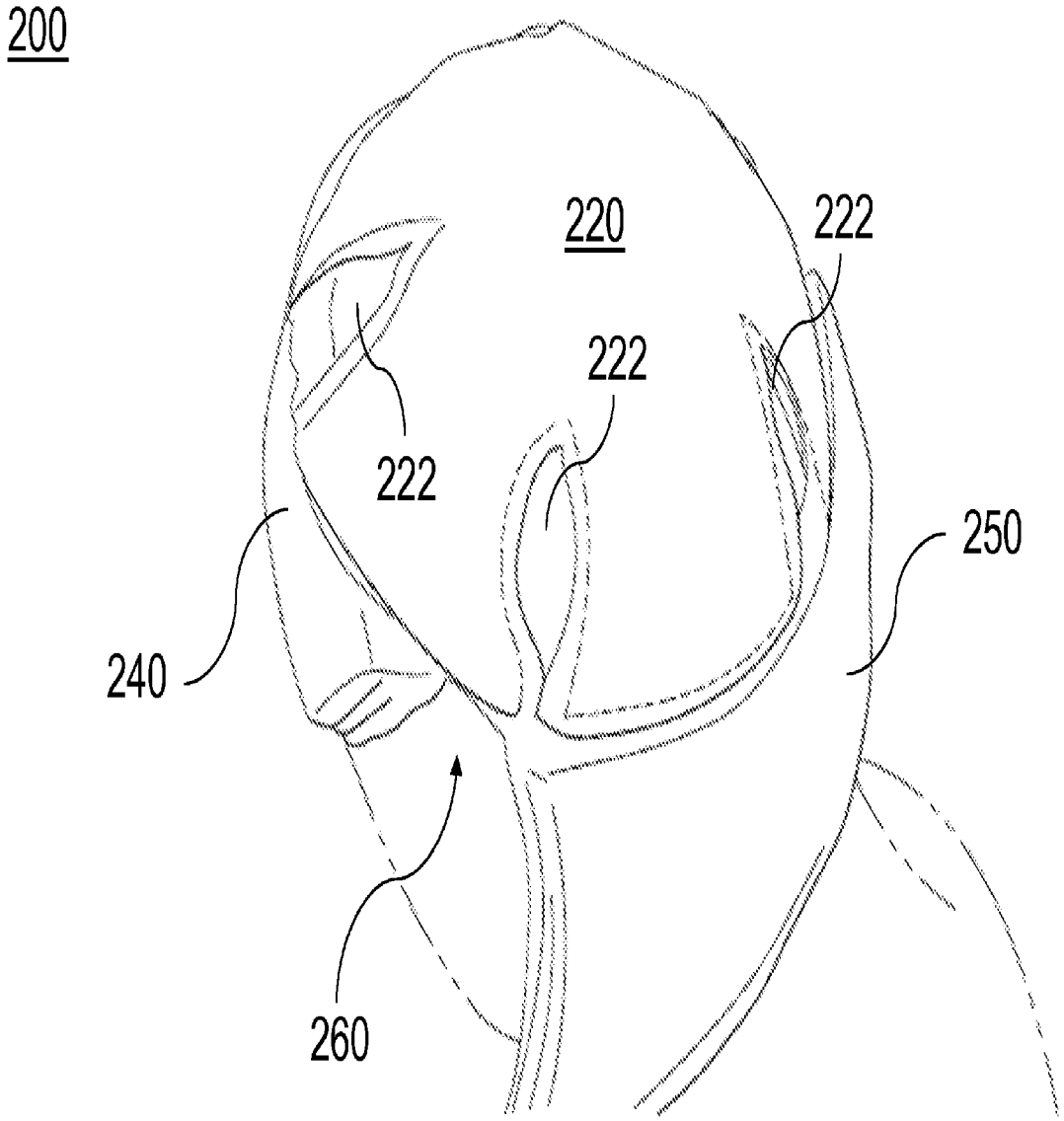

Side portions 240 and 250 are not directly connected to each other, as shown in FIG. 9A. In particular, a circumferential gap 260 is formed between side portions 240 and 250. This may be particularly desirable so that impact-resistant pad 200 may be worn by users of different head sizes. For example, when a user has a relatively small head, the gap 260 will be relatively narrow, and side portions 240 and 250 will sit close to each other (or possibly in contact with each other) when placed on the user's head. However, when a user has a relatively large head, the gap 260 will be relatively large, and side portions 240 and 250 will sit far from each other when placed on the user's head.

It will be understood that the number, shape, and size of side portions 240 and 250 in FIGS. 9A-9D is shown merely for the purposes of illustration, and is not intended to be limiting. Side portions 240 and 250 in different numbers or having different shapes or sizes may be used without departing from the scope of the present invention, as would be understood by one of ordinary skill in the art from the description herein. Impact-resistant pad 200 is formed from substantially the same materials described above with respect to spacing pad 130.

Impact-resistant pad 200 is unconnected to any supporting structure. As will be discussed in further detail herein, impact-resistant pad 200 is configured to be worn under a helmet. To this end, impact-resistant pad 200 is desirably thin. In an exemplary embodiment, impact-resistant pad 200 has a thickness of no greater than approximately 23 mm, and even more preferably, a thickness of no greater than approximately 3 mm. The thickness of impact-resistant pad 200 may be selected based on a number of factors, including for example the type of helmet, the desired level of impact protection, and the type of material encasing the pad (such as moisture-wicking, moisture-absorbent, cloth, or neoprene).

Figure 10A:
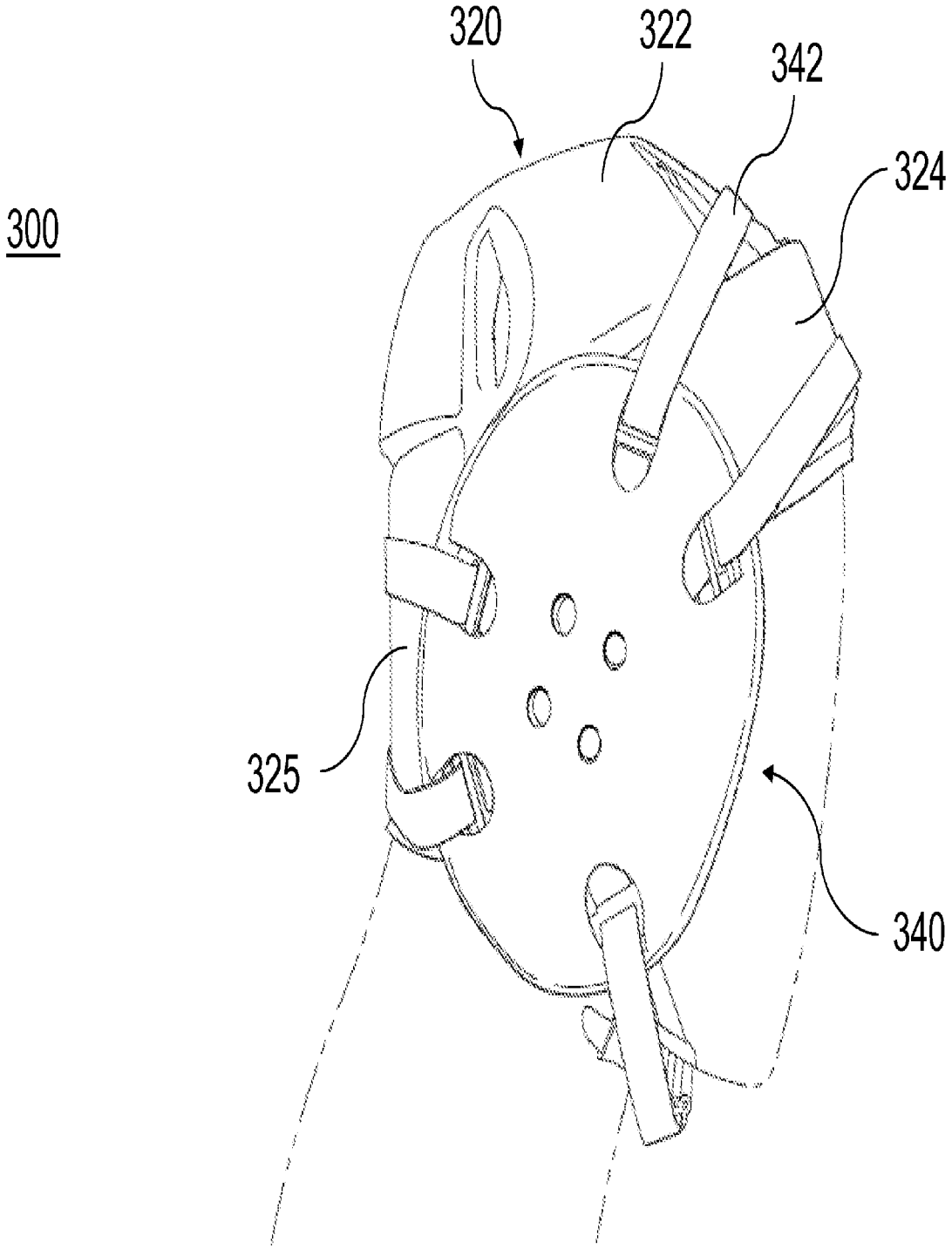
FIG. 10A-10C are images illustrating an exemplary protective headgear system in accordance with aspects of the present invention.
Figure 10B:
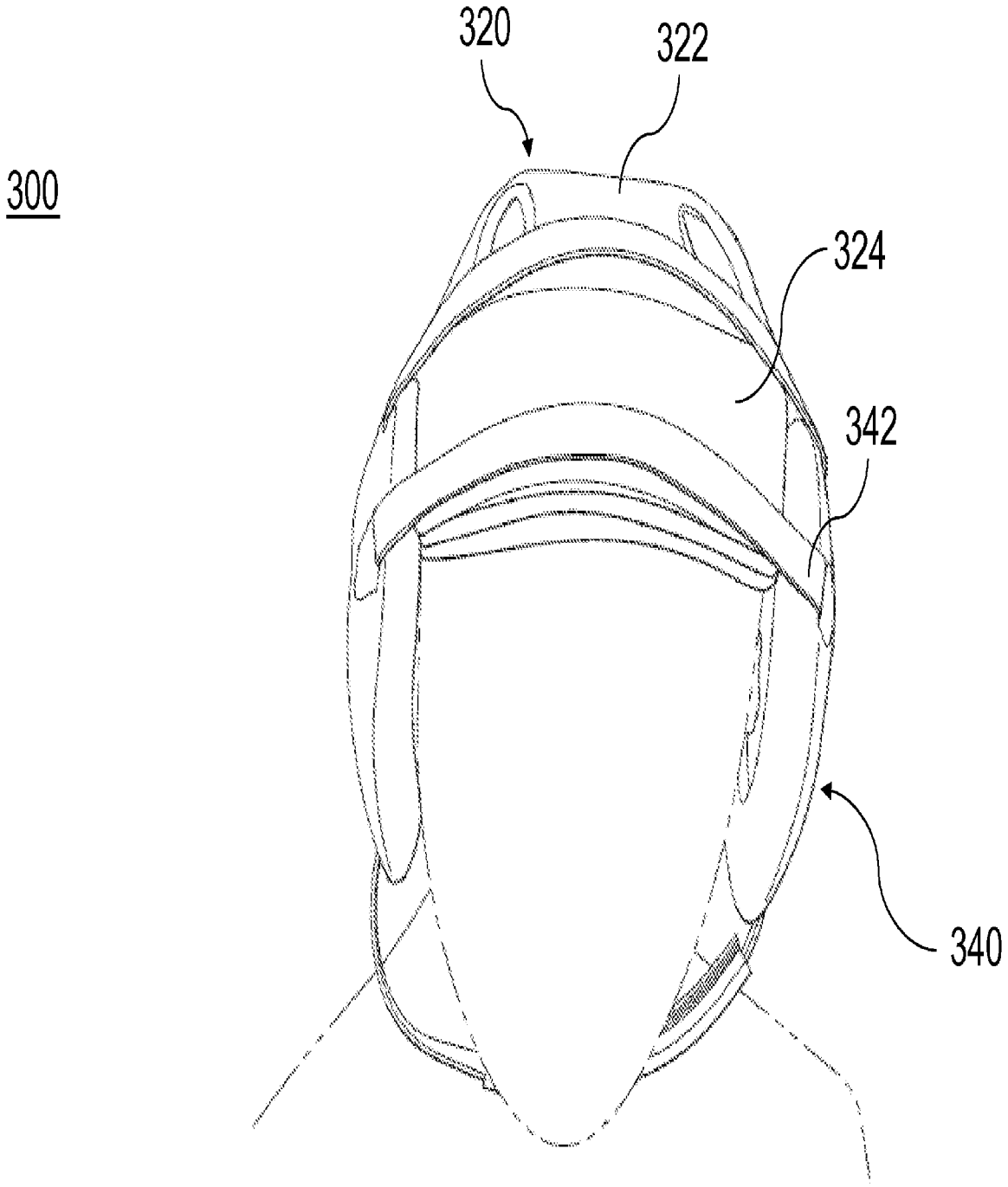
Figure 10C:
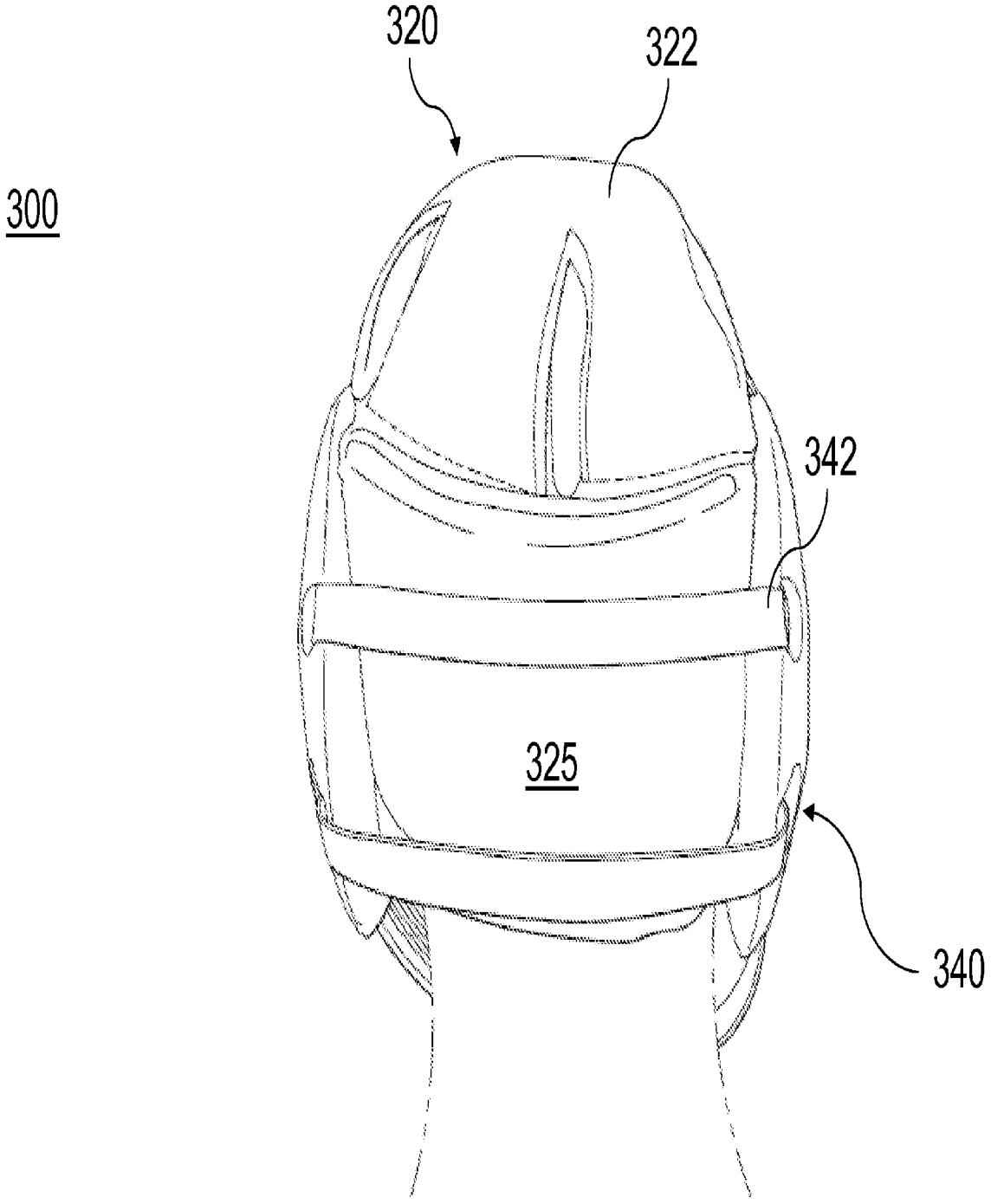

FIGS. 10A-10C illustrate an exemplary protective headgear system 300 in accordance with aspects of the present invention. Protective headgear system 300 may be worn by a user during an athletic activity, such as a wrestling match. As a general overview, protective headgear system 300 includes an impact-resistant pad 320 and a helmet 340. Additional details of protective headgear system 300 are described herein.

Impact-resistant pad 320 is formed from materials designed to dissipate the force of impacts on the user's head. In an exemplary embodiment, impact-resistant pad 320 is an impact-resistant pad substantially as described above with respect to impact-resistant pad 200. In particular, impact-resistant pad 320 includes a top portion 322 configured to be positioned covering a top of the user's head, and side portions 324 and 325 extending downward from top portion 322. Side portions 324 and 325 are not directly connected to each other, and define a circumferential gap (not shown) therebetween.

Helmet 340 is configured to be positioned on a user's head overtop of impact-resistant pad 320. Helmet 340 is unconnected to impact-resistant pad 320. When helmet 340 is positioned overtop of impact-resistant pad 320, helmet 340 covers the circumferential portions of impact-resistant pad 320. In an exemplary embodiment, helmet 340 comprises conventional wrestling headgear, as shown in FIGS. 10A-10C. Helmet 340 includes a plurality of straps 342 for securing helmet 340 to the user's head. Straps 342 extend over top portion 322 of impact-resistant pad 320. Impact-resistant pad 320 may include guide portions (not shown) for receiving and properly positioning straps 342 of helmet 340.

Figure 11:
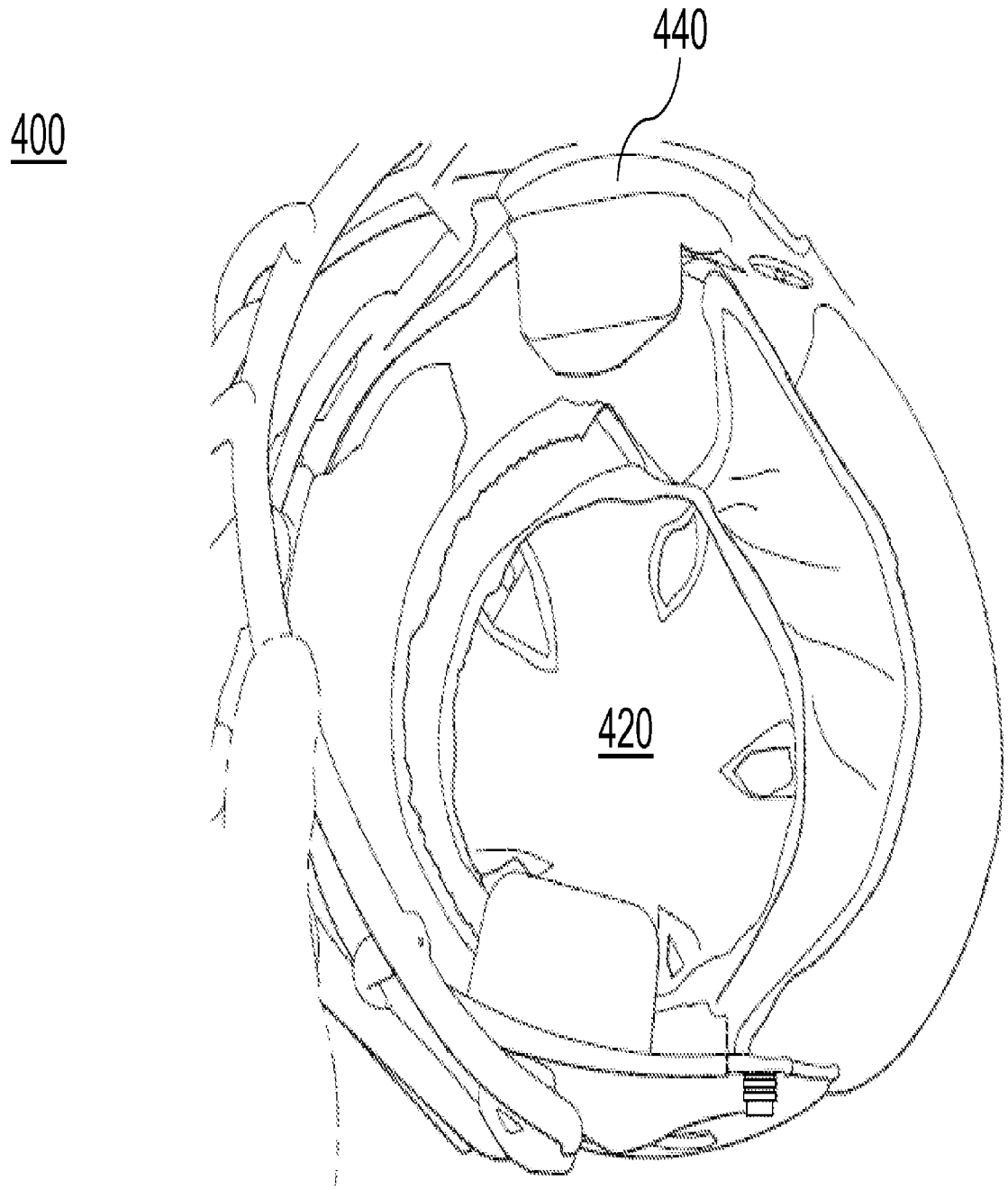
FIG. 11 is an image illustrating another exemplary protective headgear system in accordance with aspects of the present invention.

It will be understood by one of ordinary skill in the art that helmet 340 is not limited to the embodiment shown in FIGS. 10A-10C FIG. 11 illustrates another exemplary protective headgear system 400 in accordance with aspects of the present invention. As a general overview, protective headgear system 400 includes an impact-resistant pad 420 and a helmet shell 440, as shown in FIG. 11. Helmet shell 440 is configured to completely cover the user's head. This may be desirable in order to provide an additional layer of impact-resistance on top of impact-resistant pad 420. The size of helmet shell 440 is selected such that helmet 440 can accommodate impact-resistant pad 420 therein while still being securely positioned on the user's head. In an exemplary embodiment, helmet shell 440 is a helmet shell substantially as described with respect to helmet shell 110. Suitable helmet shells 440 for use with the present invention will be known to one of ordinary skill in the art from the description herein.

Figure 12:
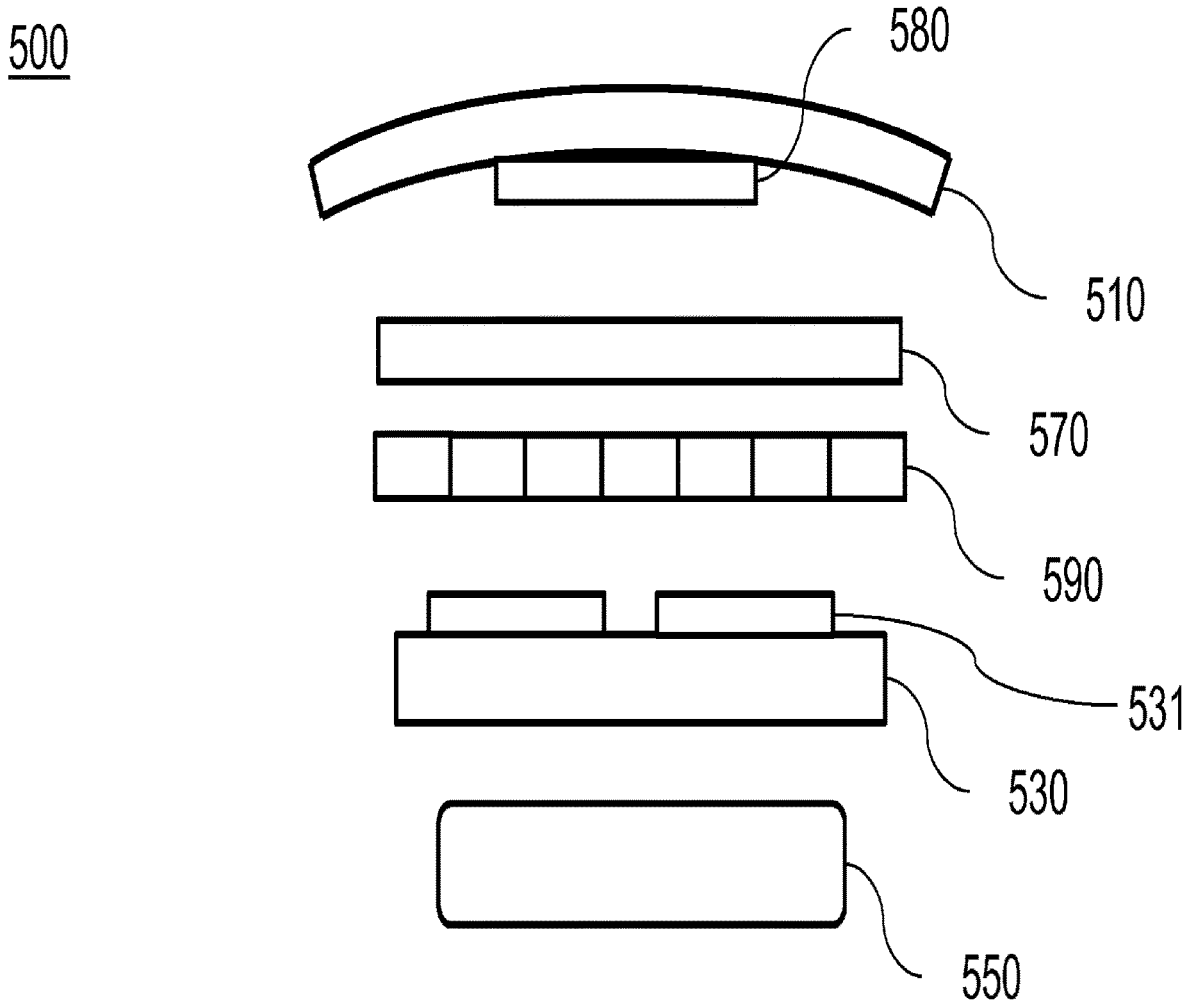
FIG. 12 is a cross-sectional diagram illustrating another exemplary helmet padding system in accordance with aspects of the present invention.

FIG. 12 illustrates an exemplary helmet padding system 500 in accordance with aspects of the present invention. FIG. 12 shows an exploded cross-sectional diagram of helmet padding system 500 through a central portion thereof. Helmet padding system 500 may also be worn by a user during an athletic activity. As a general overview, system 500 includes a helmet shell 510, a spacing pad 530, and a deflection layer 570. Additional details of system 500 are described herein.

Helmet shell 510 is configured to be positioned on a user's head. Helmet shell 510 may be a helmet shell substantially as described with respect to helmet shell 110, or may be a helmet substantially as described above with respect to helmet 340. The size of helmet shell 510 is selected such that helmet shell 510 can accommodate the remaining components of system 500 while still be securely positioned on the user's head.

Spacing pad 530 is positioned within the interior of helmet shell 510. Spacing pad 530 may be a spacing pad substantially as described with respect to spacing pad 130. Alternatively, spacing pad 530 may be an impact-resistant pad substantially as described above with respect to impact-resistant pad 200. Likewise, spacing pad 530 may be formed from any of the materials set forth above with respect to spacing pad 130 or impact-resistant pad 200, and may take any of the shapes described above with respect to spacing pad 130 and/or impact-resistant pad 200. Alternatively, spacing pad 530 may have any other shape suitable for covering a space between the user's head and the helmet shell 510. Spacing pad 530 may also comprise an array of raised portions 531 formed on a surface thereof, as described above with respect to raised portions 131.

Spacing pad 530 is not adapted to be coupled to the interior of helmet shell 510. In other words, spacing pad 530 remains unconnected to helmet shell 510 (or from any other component that is connected to helmet shell 510, e.g., conventional helmet padding provided with helmet shell 510). This enables relative movement between spacing pad 530 and helmet shell 510, which may be important to assist in dissipation of the force from impacts, as explained in further detail below with respect to deflection layer 570.

Helmet padding system 500 may include a plurality of absorption pads 550 coupled to spacing pad 530. Absorption pads 550 may be substantially the same as those described above with respect to absorption pads 150.

Deflection layer 570 is positioned between helmet shell 510 and spacing pad 530. Deflection layer 570 is formed from a material that is less flexible (i.e. stiffer) than spacing pad 530. This enables the hard surface of deflection layer 570 to deflect a portion of the force from impacts along a surface thereof, rather than transmitting that force through deflection layer 570 to spacing pad 530. In other words, it assists in converting forces from impacts into tangential forces (which propagate along the surface) as opposed to normal forces (which propagate through the surface to the user's head). In an exemplary embodiment, deflection layer 570 comprises a sheet of polycarbonate material. Deflection layer 570 may have a shape corresponding to the shape of spacing pad 530, such that the deflection layer 570 completely covers the space between spacing pad 530 and helmet shell 510.

Deflection layer 570 is also not coupled to the interior of helmet shell 510. This creates a "slip plane" between deflection layer 570 and helmet shell 510, and enables relative movement between the two components. Put another way, this allows independent movement of the user's head (with which spacing pad 530 and deflection layer 570 are in contact) and helmet shell 510.

Helmet padding system 500 may also include a plurality of deflection plates 580. Deflection plates 580 may be coupled to the interior of helmet shell 510 in positions such that they slidably abut deflection layer 570. Deflection plates 580 may be coupled to helmet shell 510, e.g., with an adhesive. Deflection plates 580 are formed from the same materials as deflection layer 570. The use of deflection plates 580 coupled to helmet shell 510 may further promote a sliding interface between deflection layer 570 and helmet shell 510, and thereby promote deflecting the force of impacts in a tangential direction along deflection layer 570, rather than through deflection layer 570 to spacing pad 530.

Helmet padding system 500 may also include a deformation layer 590. Deformation layer 590 may be positioned between deflection layer 570 and spacing pad 530. Deformation layer 590 is configured to deform upon experiencing the force from an impact. Deformation layer 590 may undergo elastic (i.e. reversible) or plastic (i.e. irreversible) deformation. In an exemplary embodiment, deformation layer 590 comprises a sheet of corrugated plastic material configured to undergo plastic deformation. As shown in FIG. 12, the sheet of corrugated plastic material may comprise a pair of plastic surface layers separated by a plurality of plastic ridges defining air gaps therebetween. Like deflection layer 570, deformation layer 590 may have a shape corresponding to the shape of spacing pad 530, such that the deformation layer 590 completely covers the space between spacing pad 530 and deflection layer 570.

Deformation layer 590 may undergo plastic deformation, for example, by crumpling, bending, fracturing, or other irreversible changes. Accordingly, deformation layer 590 may need to be periodically replaced following impacts to helmet padding system 500, where such impacts are sufficient to cause significant plastic deformation of deformation layer 590.

The above components of helmet padding system 500 may be contained in a liner (not shown). In particular, a liner may be configured to surround and contain spacing pad 530, deflection layer 570, and deformation layer 590, to maintain their relative positioning and arrangement. The liner may be formed, for example, from a cloth or nylon material to provide a comfortable contact between the user and the components of helmet padding system 500.

FIGS. 14A-14D illustrate another exemplary helmet padding system 600 in accordance with aspects of the present invention. Helmet padding system 600 may be worn by a user during military activities, e.g., under a standard military helmet. As a general overview, system 600 includes a frame 610 and a spacing pad 630. Additional details of system 600 are described herein.

Frame 610 is configured to be positioned on a user's head. Frame 610 comprises a rigid material such as, for example, a plastic or polycarbonate material. The size of frame 610 is selected such that helmet shell 610 can accommodate spacing pad 630 while still be securely positioned on the user's head.

Spacing pad 630 is coupled to frame 610. Spacing pad 630 may be a spacing pad substantially as described with respect to spacing pad 130, and/or may be formed from any of the materials described with respect to spacing pad 130. In particular, spacing pad 630 comprises a central portion 632 and a plurality of extending portions 634 projecting outward from the central portion 632. The plurality of extending portions 634 are fixed to frame 610.

Figure 14A:
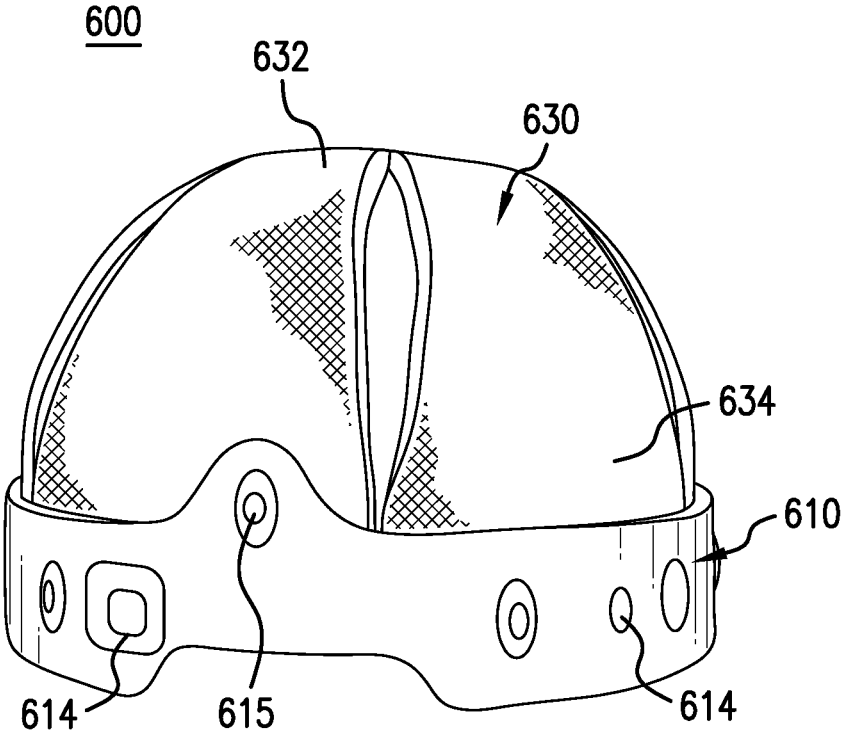
FIGS. 14A-14D are images illustrating another exemplary helmet padding system in accordance with aspects of the present invention.
Figure 14C:
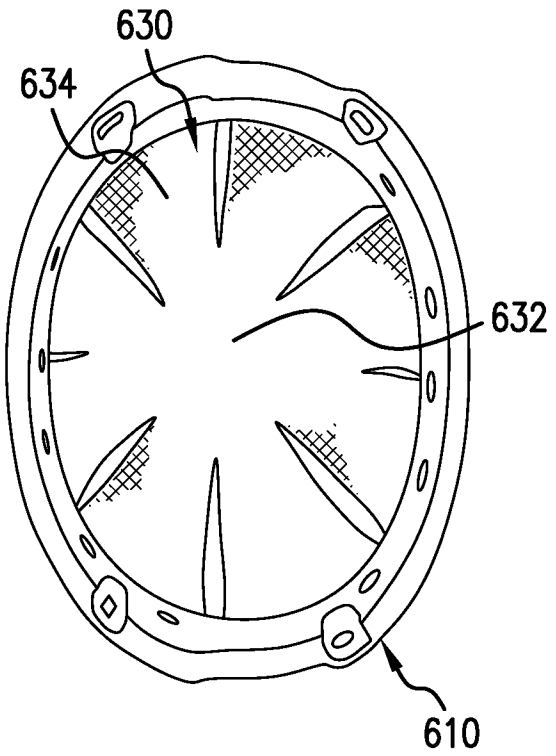
Figure 14B:
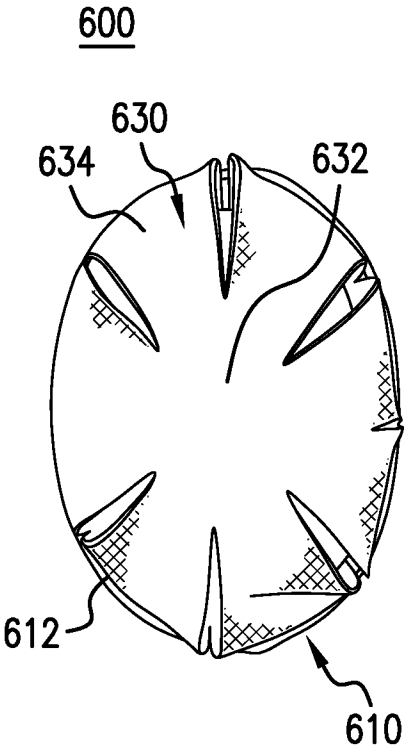

As shown in FIGS. 14A and 14B, each extending portion 630 has an end portion with a greater width than a portion of the respective extending portion coupled to central portion 632. Specifically, extending portions 630 get wider as they extend outwardly from central portion 632. The end portions of extending portions 634 are fixed to frame 610.

In an exemplary embodiment, frame 610 comprises a groove 612, as shown in FIG. 14B. The end portions of each of the plurality of extending portions 634 are inserted within groove 612. The end portions of the plurality of extending portions 634 may be additionally secured to the frame via one or more attachment mechanisms. Suitable attachment mechanisms 615 include, for example, rivets, adhesives, or stitching.

Figure 14D:
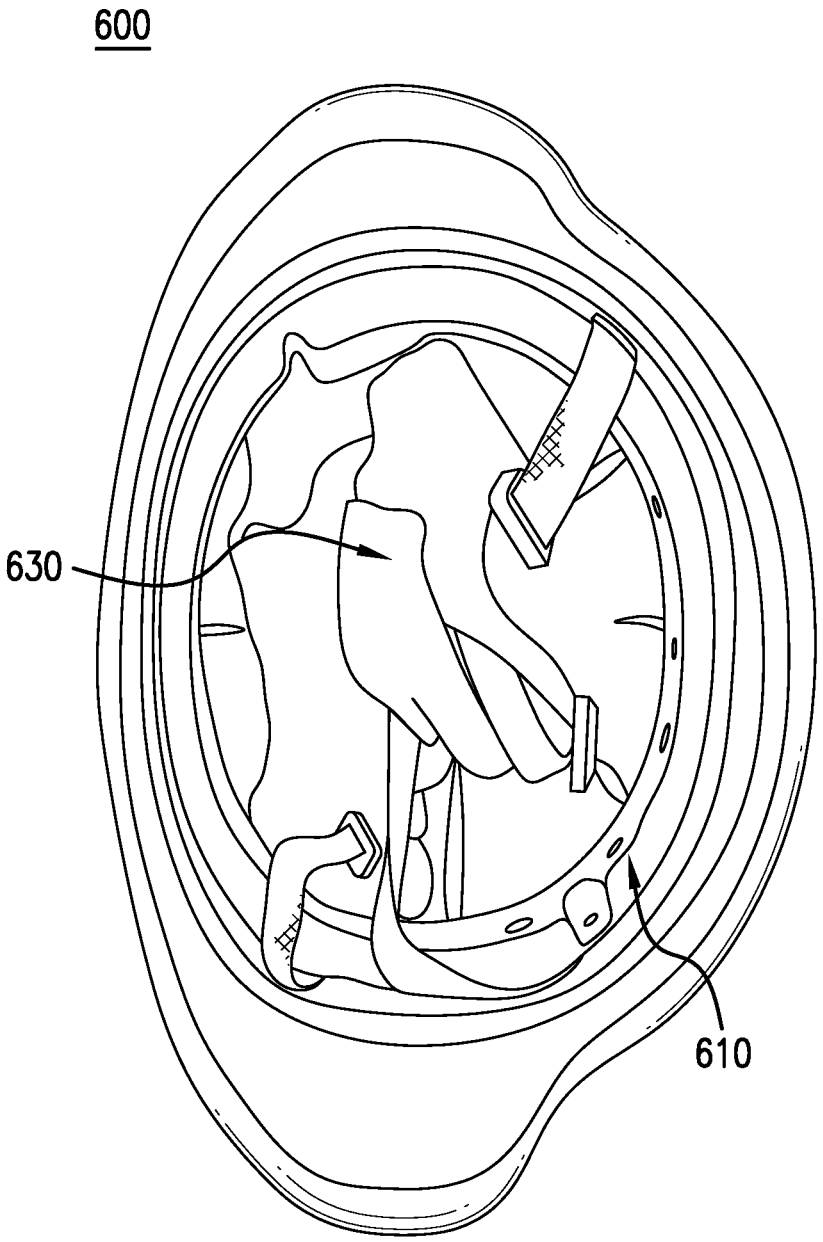

Frame 610 may be configured to be coupled to a helmet, as shown in FIG. 14D. In an exemplary embodiment, frame 610 is configured to be coupled to a standard-issue military helmet. The standard-issue military helmet includes a plurality (e.g. four) pre-arranged mounting points, such as drill holes, in the helmet. In this embodiment, frame 610 includes a plurality of through holes 614 positioned to align with the pre-arranged mounting points in the military helmet. This may desirably simplify the attachment of frame 610 to the helmet. Spacing pad 630 is fixed to frame 610 in such a way that spacing pad does not contact the helmet when frame 610 is coupled to the helmet.

In one exemplary embodiment, frame 610 has a ring shape, as shown in FIGS. 14B and 14C. The plurality of extending portions 634 extend upward from frame 610, such that central portion 623 is positioned above frame 610. This creates a cavity within frame 610 in which the top of the user's head is positioned during use.

Figure 15A:
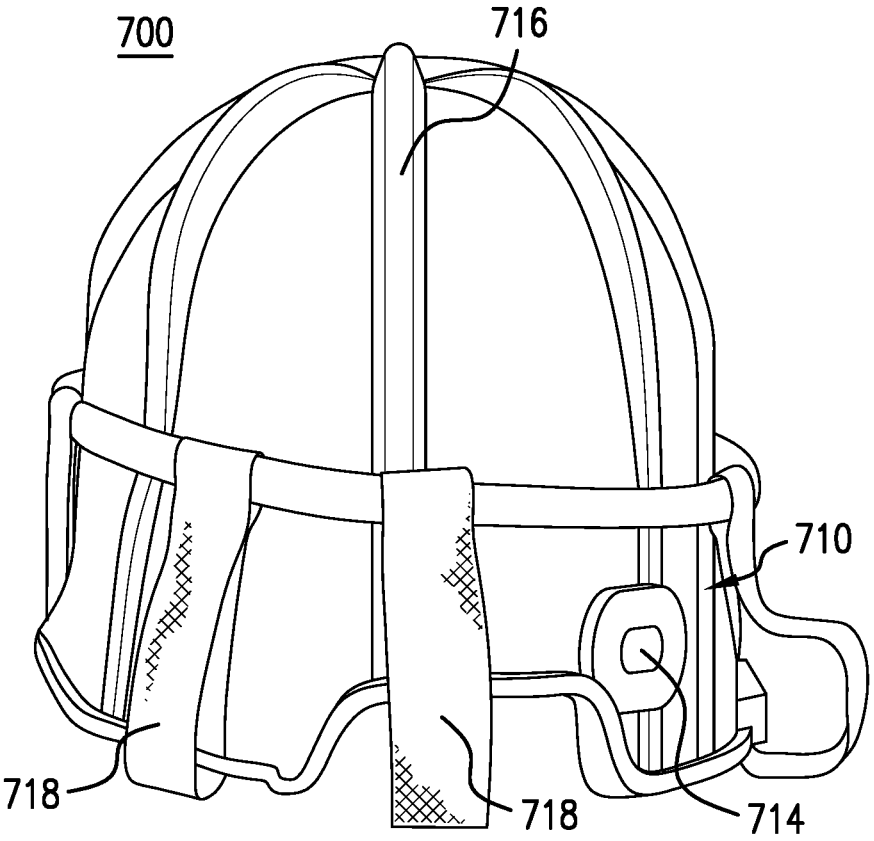
FIGS. 15A-15C are images illustrating an alternative embodiment of the exemplary helmet padding system of FIGS. 14A-14D.
Figure 15C:
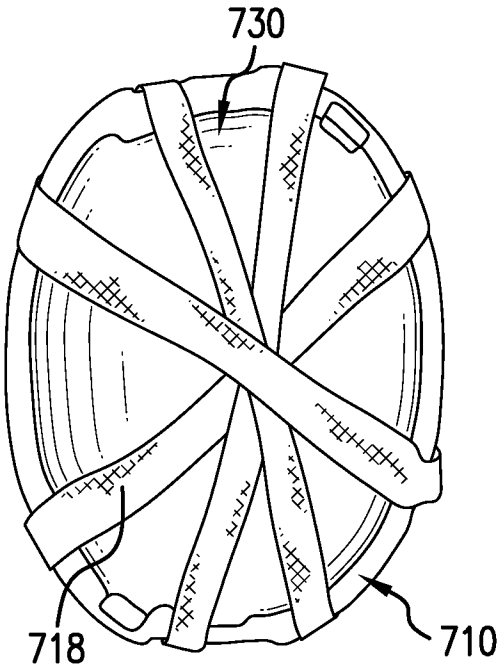
Figure 15B:
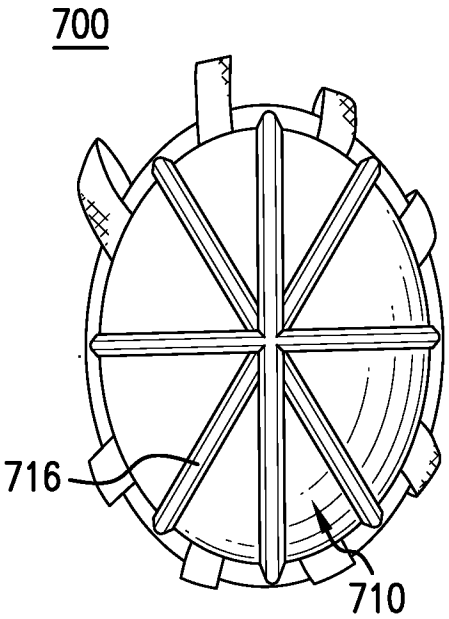

FIGS. 15A-15C illustrate another exemplary helmet padding system 700 in accordance with aspects of the present invention. The helmet padding system 700 is substantially the same as helmet padding system 600, and only the differences between those two embodiments will be described hereinafter.

In an exemplary embodiment, frame 710 of helmet padding system 700 has a dome shape, as shown in FIGS. 15A-15C. The standard-issue military helmet includes a plurality (e.g. four) pre-arranged mounting points, such as drill holes, in the helmet. In this embodiment, frame 710 includes a plurality of through holes 714 positioned to align with the pre-arranged mounting points in the military helmet.

Spacing pad 730 is positioned within the dome, and may be adhered to an inner surface of the dome. The dome-shaped frame 710 includes a plurality of ridges 716 formed on an outer surface thereof. As shown in FIGS. 15A and 15B, ridges 716 extend along frame 710 from edge to edge through a top portion of frame 710. When dome-shaped frame 710 is coupled to a helmet, frame 710 contacts the helmet only along the outermost surfaces of the plurality of ridges 716. This may be desirable in order to minimize the transfer of impact force from the helmet to frame 710. In this embodiment, frame 710 may also include a plurality of straps 718 for enhancing fit and comfort of system 700 when worn by a user, as shown in FIG. 15C.

Helmet padding systems 600 and 700 may also include a deformation layer. The deformation layer may be a layer substantially as described with respect to deformation layer 590. In one embodiment, the deformation layer is positioned between the frame and the spacing pad. In an alternative embodiment, the deformation layer is positioned such that it is between the frame and the helmet when the frame is coupled to the helmet.

Although the invention is illustrated and described herein with reference to specific embodiments, the invention is not intended to be limited to the details shown. Rather, various modifications may be made in the details within the scope and range of equivalents of the claims and without departing from the invention. In particular, any of the features described herein with respect to one embodiment may be provided in any of the other embodiments.

The invention claimed is:

1. A multi-layer energy dispersing panel for frictional insertion into a headpiece, said panel comprising:

a central portion configured to receive a top of a user's head and at least two extending portions configured to extend from said central portion to receive at least a side portion of the user's head when said panel is positioned to engagedly couple within the headpiece, wherein the extending portions terminate, at an end distal from the central portion, in a contiguous shape having a preferential curvature imparted by a spacing pad for absorbing a blow, wherein the distal end of the extending portions is wider than an end of the extending portion proximal to the central portion such that the widened distal ends overlap upon insertion to the headpiece to provide a doubled-thickness energy dispersing portion, wherein said panel comprises a multi-layer composite comprising:

a first absorption layer;

a reinforced elastomeric composite suitable to dissipate and redirect energy, comprising:

a high tensile strength fibrous aramid material, wherein the high tensile strength fibrous aramid material defines a major material surface, disperses energy to facilitate energy dampening and is inelastic in a direction perpendicular to the major material surface;

a first elastomeric material layer that is contiguous with a first side of the high tensile strength fibrous aramid material; and a second elastomeric material layer that is contiguous with a second side of the high tensile strength fibrous aramid material.

2. The energy dispersing panel of claim 1, wherein said high tensile strength fibrous aramid material is positioned between and coextensive with said first and second elastomeric layers.

3. The energy dispersing panel of claim 1, wherein said panel comprises at least four extending portions.

4. The energy dispersing panel of claim 1, wherein when said panel is being worn by a user underneath a headpiece, the majority of the side surfaces of each extending portion are in contact with the side surfaces of the next closest extending portions.

5. The energy dispersing panel of claim 1, wherein said first absorption layer further comprises a plurality of projecting sections and areas of foldable creases to form grooves having polygon shapes.

6. The energy dispersing panel of claim 1, wherein the thickness of said energy dispersing panel is 5 mm or less.

7. The energy dispersing panel of claim 1, wherein said panel is configured for insertion within a soft cap.

8. The energy dispersing panel of claim 1, wherein said panel is configured for insertion within a helmet containing pre-existing padding.

9. The energy dispersing panel of claim 1, further comprising a second absorption layer made at least partially of a closed cell foam.

10. The energy dispersing panel of claim 1, further comprises aramid fibers.

11. The energy dispersing panel of claim 1, further comprising a rigid deflection layer wherein said rigid deflection layer distributes energy in a direction perpendicular to the direction of the energy's point of entry.

12. The energy dispersing panel of claim 11, wherein said rigid deflection layer is selected from the group consisting of polypropylene and polycarbonate.

13. A multi-layer energy dispersing panel for frictional insertion into a headpiece, said panel comprising:

a central portion configured to receive a top of a user's head and at least two extending portions configured to extend from said central portion to receive at least a side portion of the user's head when said panel is engagedly couple within the headpiece, wherein the extending portions terminate, at an end distal from the central portion, in a contiguous shape having a preferential curvature imparted by a spacing pad for absorbing a blow, wherein the distal end of the extending portions is wider than an end of the extending portion proximal to the central portion such that the widened distal ends overlap upon insertion to the headpiece to form an enhanced energy dispersing portion, wherein said panel comprises a multi-layer composite comprising:

a rigid deflection layer wherein said rigid deflection layer comprises a major material surface and distributes at least a portion of received energy in a direction perpendicular to the direction of entry of the received energy;

a first absorption layer comprising a foam, wherein the first absorption layer further comprises a plurality of projecting sections and areas of foldable creases to form grooves having polygon shapes; and a reinforced elastomeric composite suitable to dissipate and redirect energy, comprising:

a high tensile strength fibrous aramid material, wherein the high tensile strength fibrous material defines a major material surface, disperses energy to facilitate energy dampening and is inelastic in a direction perpendicular to the major material surface;

a first elastomeric material layer that is contiguous with a first side of the high tensile strength fibrous aramid material; and a second elastomeric material layer that is contiguous with a second side of the high tensile strength fibrous aramid material.

14. The energy dispersing panel of claim 13, wherein said high tensile strength fibrous aramid material is positioned between and coextensive with said first and second elastomeric layers.

15. The energy dispersing panel of claim 13, comprising at least four extending portions.

16. The energy dispersing panel of claim 15, wherein when said panel is being worn by a user underneath a headpiece, the majority of the side surfaces of each extending portion are in contact with the side surfaces of the next closest extending portions.

17. The energy dispersing panel of claim 13, wherein the thickness of said energy dispersing panel is 5 mm or less.

18. The energy dispersing panel of claim 13, wherein said panel is configured for insertion within a soft cap.

19. The energy dispersing panel of claim 13, wherein said panel is configured for insertion within a helmet containing pre-existing padding.

20. The energy dispersing panel of claim 13, further comprising a second absorption layer made at least partially of a closed cell foam.

21. The energy dispersing panel of claim 13, further comprises aramid fibers.

22. The energy dispersing panel of claim 13, wherein the reinforced elastomeric composite is configured to be closest to the interior material of the headpiece when said panel is inserted into the headpiece and is further configured such that the high tensile strength fibrous aramid material is positioned between the first and second elastomeric layers, and wherein the first absorption layer is adjacent to the reinforced elastomeric composite and closest to the head of a user.

23. The energy dispersing panel of claim 13, wherein the rigid deflection layer is configured to be closest to the interior material of the headpiece when said panel is inserted into the headpiece, the reinforced elastomeric composite is configured to be adjacent to the rigid deflection layer and is further configured such that the high tensile strength fibrous aramid material is positioned between the first and second elastomeric layers, and wherein the first absorption layer is adjacent to the reinforced elastomeric composite and closest to the head of the user.

24. A multi-layer energy dispersing panel for insertion into a headpiece, said panel comprising:

a central portion configured to receive a top of a user's head and at least four extending portions configured to extend from said central portion to receive at least a side portion of the user's head when said panel is fastened by engagedly coupling within the headpiece, and further configured to couple to a soft cap by fitting within a space between the cap and an internal band that is continuous with the internal circumference of the cap, wherein the extending portions terminate, at an end distal from the central portion, in a contiguous shape having a preferential curvature imparted by a spacing pad for absorbing a blow, wherein the distal end of the extending portions is wider than an end of the extending portion proximal to the central portion such that the widened distal ends overlap upon insertion to the headpiece to form a thickened energy dispersing portion, wherein said panel comprises a multi-layer composite comprising:

a rigid deflection layer wherein, said rigid deflection layer comprises a major material surface and distributes at least a portion of received energy in a direction perpendicular to the direction of entry of the received energy;

a first absorption layer comprising foam, wherein the first absorption layer further comprises a plurality of projecting sections and areas of foldable creases to form grooves having polygon shapes; and a reinforced elastomeric composite suitable to dissipate and redirect energy, comprising:

a high tensile strength fibrous aramid material, wherein the high tensile strength fibrous material defines a major material surface, disperses energy to facilitate energy dampening and is inelastic in a direction perpendicular to the major material surface;

a first elastomeric material layer that is contiguous with a first side of the high tensile strength fibrous aramid material; and a second elastomeric material layer that is contiguous with a second side high tensile strength fibrous aramid material.

* * * * *